US005679501A

United States Patent [19]

Seki et al.

[11] Patent Number: 5,679,501

[45] Date of Patent: Oct. 21, 1997

[54] PROCESSING COMPOSITION FOR SILVER HALIDE PHOTOGRAPHIC MATERIAL AND PROCESSING METHOD USING SAME

[75] Inventors: Hiroyuki Seki; Hisashi Okada, both of Kanagawa, Japan

[73] Assignee: Fuji Photo Film Co., Ltd., Kanagawa, Japan

[21] Appl. No.: 366,004

[22] Filed: Jan. 3, 1995

Related U.S. Application Data

[63] Continuation of Ser. No. 52,101, Apr. 23, 1993, abandoned.

[30] Foreign Application Priority Data

Apr. 24, 1992 [JP] Japan ..... 4-129769

[51] Int. Cl.[6] ..... G03C 7/00; G03C 5/42; G03C 5/44; G03C 5/18

[52] U.S. Cl. ..... 430/393; 430/430; 430/461; 430/418; 430/963; 430/460

[58] Field of Search ..... 430/393, 418, 430/430, 460, 461, 943

[56] References Cited

U.S. PATENT DOCUMENTS

| | | | |
|---|---|---|---|
| 4,301,236 | 11/1981 | Idora et al. | 430/943 |
| 4,328,326 | 5/1982 | Idora et al. | 430/943 |
| 4,704,233 | 11/1987 | Hartman et al. | 252/527 |
| 4,804,618 | 2/1989 | Ueda et al. | 430/430 |
| 4,983,315 | 1/1991 | Glogowski et al. | 252/102 |
| 5,026,629 | 6/1991 | McGuckin et al. | 430/455 |
| 5,070,004 | 12/1991 | Fujira et al. | 430/393 |
| 5,316,898 | 5/1994 | Ueda et al. | 430/461 |
| 5,580,705 | 12/1996 | Ueda et al. | 430/430 |
| 5,585,226 | 12/1996 | Strickland et al. | 430/430 |

FOREIGN PATENT DOCUMENTS

| | | | |
|---|---|---|---|
| 0532003A1 | 10/1992 | European Pat. Off. . | |
| 5072695 | 3/1993 | Japan | 430/430 |
| 1043137 | 9/1983 | U.S.S.R. . | |

OTHER PUBLICATIONS

J. Majer et al., *Chem. Zvesti* 20(6), pp. 414–422 (1966).

K. Ueno, *Chelate Chemistry* vol. 5, section 1, pp. 309, 311, 324.

J. Neal et al., *Inorg. Chem.*, vol. 7, No. 11, pp. 2405–2412, 1968.

*Primary Examiner*—Glenn A. Caldarola
*Assistant Examiner*—J. Pasterczyk
*Attorney, Agent, or Firm*—Sughrue, Mion, Zinn, Macpeak & Seas, PLLC

[57] ABSTRACT

A novel process and processing composition for processing a silver halide photographic material is disclosed. The processing composition is an aqueous solution of a ferric (III) complex salt of an [S,S] optical isomer of a compound represented by formula (I):

(I)

wherein $R_1$, $R_2$, $R_3$, $R_4$, $R_5$ and $R_6$ each represents a hydrogen atom, an aliphatic group, an aromatic group or a hydroxyl group; W represents a divalent linking group containing carbon atoms; and $M_1$, $M_2$, $M_3$ and $M_4$ each represents a hydrogen atom or a cation. The processing composition is useful for bleaching a silver halide color photographic material. A process for processing a silver halide color photographic material is further disclosed, employing the above described process composition containing a ferric (III) complex salt of the compound of formula (I) as a bleaching agent.

36 Claims, No Drawings

PROCESSING COMPOSITION FOR SILVER HALIDE PHOTOGRAPHIC MATERIAL AND PROCESSING METHOD USING SAME

This is a continuation of application Ser. No. 08/052,101 filed Apr. 23, 1993, now abandoned.

FIELD OF THE INVENTION

The present invention relates to a processing composition for processing a silver halide photographic material. More particularly, the present invention relates to a bleaching composition for processing a silver halide color photographic material (hereinafter also referred to as "photographic material") having excellent desilvering properties, photographic properties and image preservability after processing, and a processing method using the bleaching composition.

BACKGROUND OF THE INVENTION

A color photographic material which has been exposed to light is generally color-developed, and then processed with a processing solution having a bleaching capacity. Bleaching agents contained in the processing solution having a bleaching capacity include widely known ferric complex salts. Among these ferric complex salts, ferric complex salts of ethylenediaminetetraacetic acid (EDTA) have long been used. Ferric complex salts of 1,3-diaminopropanetetraacetic acid (1,3-PDTA) having a higher bleaching power have been widely used within the last several years.

Ferric complex salts of 1,3-PDTA allow the photographic material to be processed more rapidly than ferric complex salts of EDTA. However, due to its strong oxidizing power, these ferric complex salts tend to cause bleach fog. These ferric complex salts are also disadvantageous in that the image preservability after processing is subject to deterioration (i.e., increase in magenta stain). Thus, investigators have gone to great lengths in order to develop a practically useful bleaching system employing a ferric complex salt of 1,3-PDTA.

The photographic industry is concerned with the development of processing agents which minimize the pollution burden on the environment in light of recently rising environmental awareness. Accordingly, there is a need for substitute bleaching agents for the scarcely biodegradable ferric complex salts of EDTA or 1,3-PDTA.

These metallic complex salts are also contained in processing compositions such as intensification, reduction and toning compositions for treatment of black-and-white photographic materials, after development and fixing. However, complex salts of EDTA or 1,3-PDTA still present a problem of biodegradation in this application.

SUMMARY OF THE INVENTION

It is therefore an object of the present invention to provide a processing composition comprising a processing agent that exhibits little pollution burden on the environment, and a processing method using such a processing composition.

It is another object of the present invention to provide a processing composition having a bleaching capacity which exhibits excellent desilvering properties, causes no bleach fog and provides excellent image preservability after processing.

These and other objects of the present invention will become more apparent from the following detailed description and Examples.

As a result of their investigation of the above-described problems of the prior art, the present inventors discovered that the aforementioned objects of the present invention are accomplished with the following processing compositions and by the following processing method:

(1) A processing composition for processing a silver halide photographic material, comprising an aqueous solution of a ferric (III) complex salt of a compound represented by formula (I):

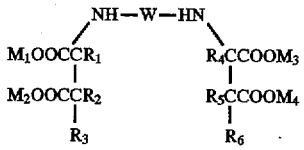

wherein $R_1$, $R_2$, $R_3$, $R_4$, $R_5$ and $R_6$ each represents a hydrogen atom, a substituted or unsubstituted aliphatic group, a substituted or unsubstituted aromatic group or a hydroxyl group; W represents a divalent linking group containing carbon atoms; and $M_1$, $M_2$, $M_3$ and $M_4$ each represents a hydrogen atom or a cation.

(2) A bleaching composition for processing a silver halide color photographic material, comprising an aqueous solution of a ferric (III) complex salt of a compound represented by formula (I) as defined above.

(3) A process for processing an imagewise exposed silver halide color photographic material comprising a support having thereon at least one light-sensitive silver halide emulsion layer, comprising the steps of developing in a color developing solution and processing in a processing solution having a bleaching capacity, said processing solution having a bleaching capacity containing a bleaching agent which is a ferric (III) complex salt of a compound represented by formula (I) as defined above.

DETAILED DESCRIPTION OF THE INVENTION

The compound represented by formula (I) is further described below.

The aliphatic group represented by $R_1$, $R_2$, $R_3$, $R_4$, $R_5$ and $R_6$ is a straight-chain, branched or cyclic alkyl group, alkenyl group or alkinyl group, preferably having 1 to 10 carbon atoms. Preferred among these aliphatic groups is an alkyl group, more preferably a $C_{1-4}$ alkyl group. Particularly preferred among these aliphatic groups are methyl group and ethyl group.

The aromatic group represented by $R_1$, $R_2$, $R_3$, $R_4$, $R_5$ and $R_6$ is a $C_{6-10}$ monocyclic or bicyclic aryl group such as phenyl and naphthyl group, more preferably phenyl group.

The aliphatic group and aromatic group represented by $R_1$, $R_2$, $R_3$, $R_4$, $R_5$ and $R_6$ may be substituted. Examples of these substituents include alkyl group (e.g., methyl, ethyl), aralkyl group (e.g., phenylmethyl), alkenyl group (e.g., allyl), alkinyl group, alkoxy group (e.g., methoxy, ethoxy), aryl group (e.g., phenyl, p-methylphenyl), amino group (e.g., dimethylamino), acylamino group (e.g., acetylamino), sulfonylamino group (e.g., methanesulfonylamino), ureido group, urethane group, aryloxy group (e.g., phenyloxy), sulfamoyl group (e.g., methylsulfamoyl), carbamoyl group (e.g., carbamoyl, methylcarbamoyl), alkylthio group (e.g., methylthio), arytthio group (e.g., phenylthio), sulfonyl group (e.g., methanesulfonyl), sulfinyl group (e.g., methanesulfinyl), hydroxyl group, halogen atom (e.g., chlorine atom, bromine atom, fluorine atom), cyano group, sulfo group, carboxyl group, phosphono group, aryloxycarbonyl group (e.g., phenyloxycarbonyl), acyl group (e.g., acetyl, benzoyl), alkoxycarbonyl group (e.g., methoxycarbonyl), acyloxy group (e.g., acetoxy), carbonamide group, sulfonamide group, nitro group, and hydroxamic acid group. These substituents may be in the form of a dissociated product or salt as appropriate, for example, a carboxylate, sulfonate, phosphonate, alkalimetal salt thereof (lithium salt, sodium salt, potassium salt, etc.), and ammonium salt thereof.

If the above described substituent has carbon atoms, the number of carbon atoms contained therein is preferably from 1 to 4.

$R_1$, $R_2$, $R_3$, $R_4$, $R_5$ and $R_6$ each is preferably a hydrogen atom or a hydroxyl group, more preferably a hydrogen atom.

The divalent linking group represented by W is preferably represented by the following formula (W):

$$-(W^1\text{-}D)_m-(W^2)_n- \qquad (W)$$

In formula (W), $W^1$ and $W^2$, which may be the same or different, each represents a methylene group, a substituted or unsubstituted $C_{2-8}$ straight-chain or branched alkylene group (e.g., ethylene, propylene), a substituted or unsubstituted $C_{5-10}$ cycloalkylene group (e.g., 1,2-cyclohexyl), a substituted or unsubstituted $C_{6-10}$ arylene group (e.g., o-phenylene), a substituted or unsubstituted $C_{7-10}$ aralkylene group (e.g., o-xylenyl), a divalent nitrogen-containing heterocyclic group or a carbonyl group. D represents —O—, —S—, —N($R_w$)— or a divalent nitrogen-containing heterocyclic group. $R_w$ represents a hydrogen atom or a $C_{1-8}$ alkyl group or a $C_{6-10}$ aryl group (e.g., phenyl) which $C_{1-8}$ alkyl group or $C_{6-10}$ aryl group may be substituted by —$COOM_a$, —$PO_3M_b$, $M_c$, —OH or —$SO_3M_d$. $M_a$, $M_b$, $M_c$ and $M_d$ each represents a hydrogen atom or a cation. Examples of the cation include an alkaline metal (e.g., lithium, sodium, potassium), ammonium (e.g., ammonium, tetraethylammonium), and pyridinium. The linking group represented by W may be substituted. Examples of substituents for $W^1$ and $W^2$ include those described with reference to $R_1$ to $R_4$.

The divalent nitrogen-containing heterocyclic group represented by D, $W^1$ and $W^2$ is preferably a 5- or 6-membered divalent nitrogen-containing heterocyclic group containing nitrogen atom as a hetero atom, and more preferably one which is connected to $W^1$ and $W^2$ via its adjacent carbon atoms, such as an imidazolyl group.

$W^1$ and $W^2$ each is preferably a substituted or unsubstituted $C_{2-4}$ alkylene group.

The suffix m represents 0 or an integer of 1 to 3. When m is 2 or 3, the plurality of ($W^1$-D) groups may be the same or different. The suffix m is preferably an integer of 0 to 2, more preferably 0 or 1, particularly 0. The suffix n represents an integer of 1 to 3. When n is 2 or 3, the plurality of ($W^2$) groups may be the same or different. The suffix n is preferably 1 or 2.

Specific examples of W are given below.

$$\text{-}(CH_2)_2\text{-},\quad \text{-}(CH_2)_3\text{-},\quad \text{-}(CH_2)_4\text{-},\quad -CH(CH_3)CH_2-,$$

$$-CH_2CH(OH)CH_2-,\quad -CH_2CH_2OCH_2CH_2-,$$

-continued $$-CH_2CH_2OCH_2CH_2OCH_2CH_2-,\quad -CH_2CH_2SCH_2CH_2-,$$

$$-CH_2CH_2SCH_2CH_2SCH_2CH_2-,\quad -CH_2CH_2N(CH_2COOH)CH_2CH_2-,$$

$$-CH_2CH_2N(CH_2COOH)CH_2CH_2N(CH_2COOH)CH_2CH_2-,\quad -C(=O)CH_2-,\quad -C(=O)-C(=O)-,$$

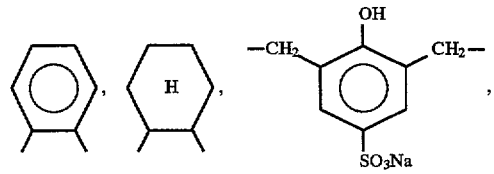

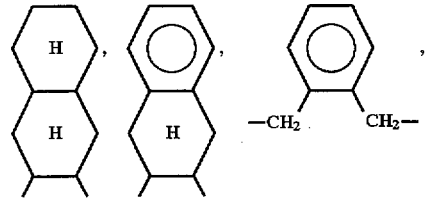

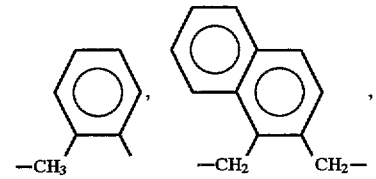

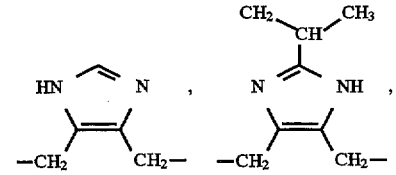

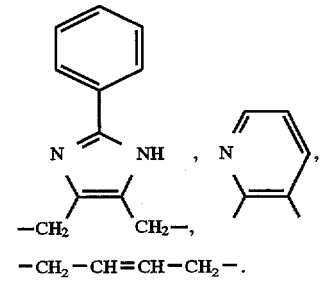

$$-CH_2-CH=CH-CH_2-.$$

Examples of the cation represented by $M_1$, $M_2$, $M_3$ or $M_4$ include an alkaline metal (e.g., lithium, sodium, potassium), ammonium (e.g., ammonium, tetraethylammonium), and pyridinium.

Specific examples of the compound represented by the aforementioned formula (I) of the present invention are given below, but the present invention should not be construed as being limited thereto..

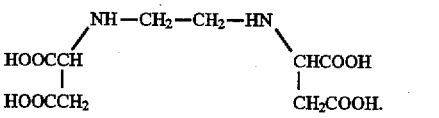
I-1
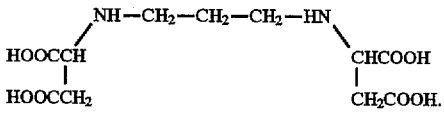
I-2
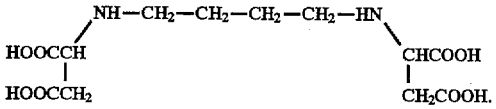
I-3
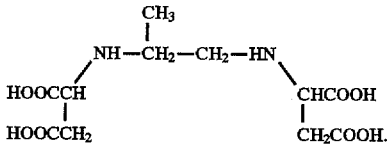
I-4
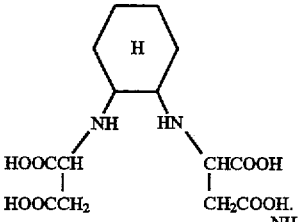
I-5
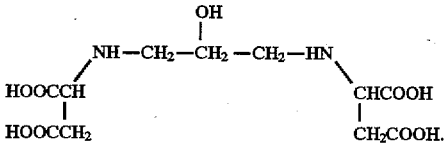
I-6
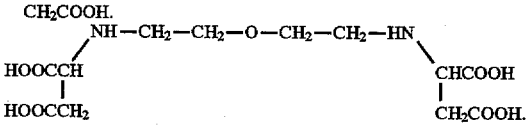
I-7
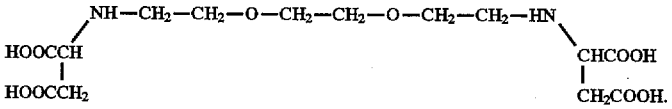
I-8
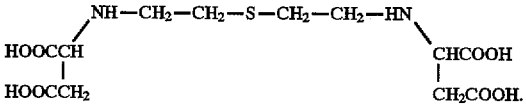
I-9
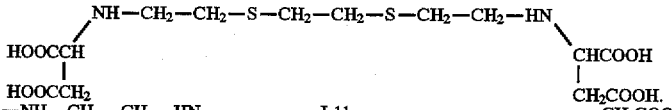
I-10
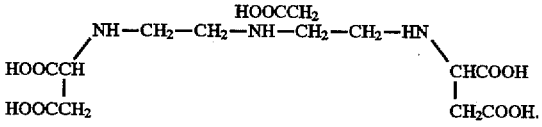
I-11
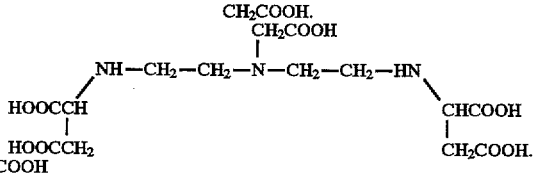
I-12
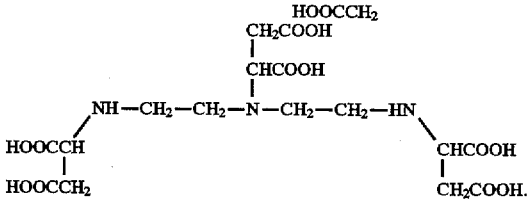
I-13
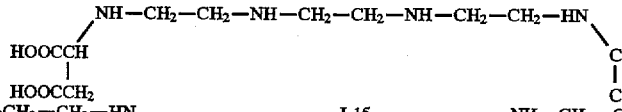
I-14
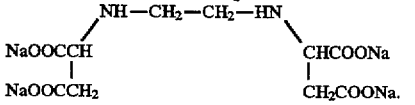
I-15
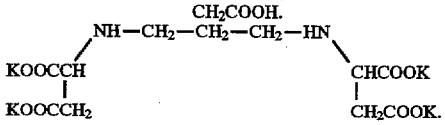
I-16
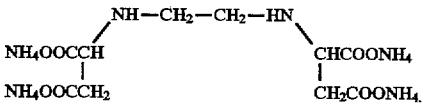
I-17
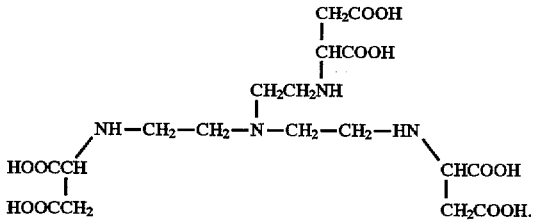
I-18

-continued

I-19

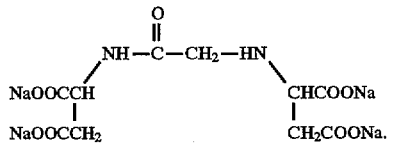

I-20

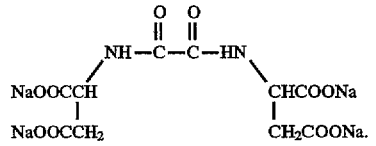

I-21

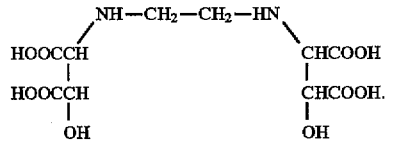

I-22

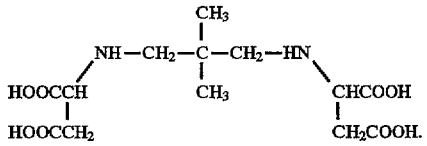

I-23

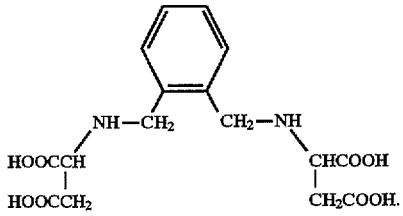

I-24

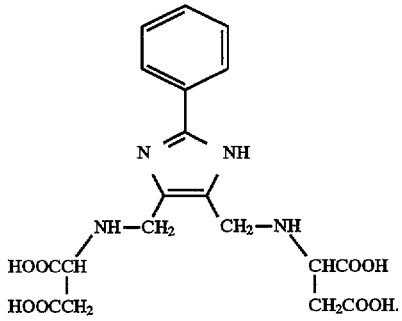

I-25

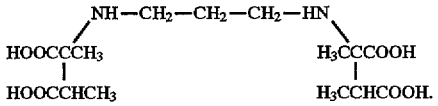

I-26

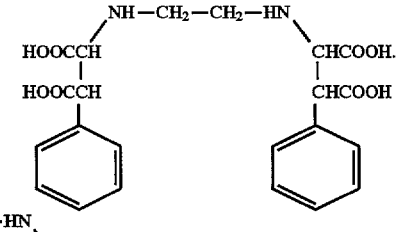

I-27

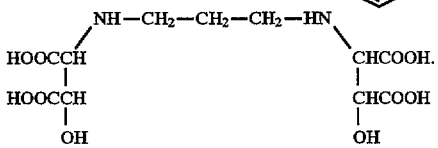

The compound represented by formula (I) can be synthesized in accordance with the method described in U.S. Pat. Nos. 4,704,233 and 4,983,315. As described in these references, the compound represented by formula (I) of the present invention has optical isomers ([R,R], [S,S], [S,R], [R,S]). For example, the exemplary compound (I-1) represented by formula (I) of the present invention has three optical isomers ([R,R], [S,S], [S,R]). These optical isomers may be individually synthesized or may be synthesized in admixture. The present invention includes these individual optical isomers or mixtures thereof. However, these references relate to a detergent composition comprising a compound represented by formula (I) of the present invention as a chelating agent, and do not contemplate use of the ferric complex salts (III) thereof as bleaching agents for processing a silver halide photographic material. These references are also silent with respect to biodegradability of these ferric complex salts (III). Among the ferric complex compounds of the present invention, ferric complexes (III) of a compound synthesized from an amino acid in L-form such as [S,S] are preferred to other optical isomers.

As used herein, the term "ferric (III)" means the $Fe^{3+}$ oxidation state of iron.

Specific examples of the ferric (III) complex salts of the present invention are given below, the present invention should not be construed as being limited thereto.

K-1

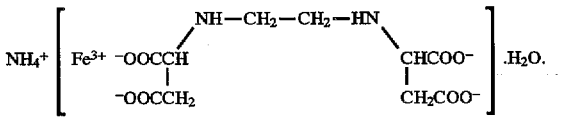

K-2

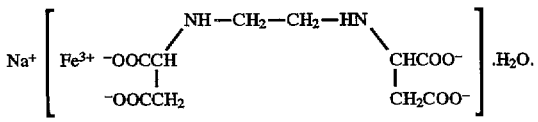

-continued

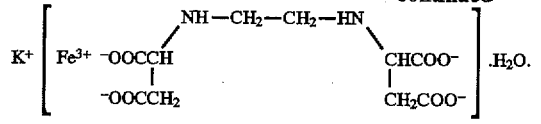

K-3

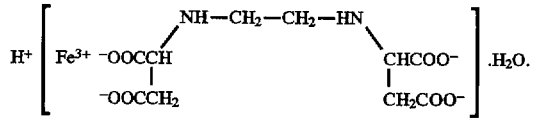

K-4

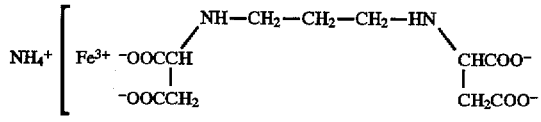

K-5

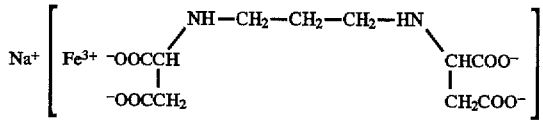

K-6

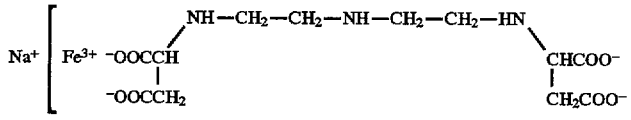

K-7

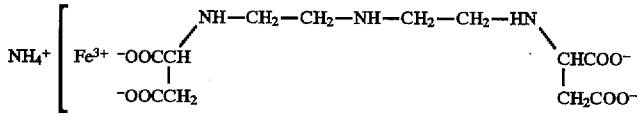

K-8

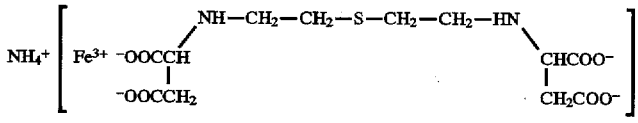

K-9

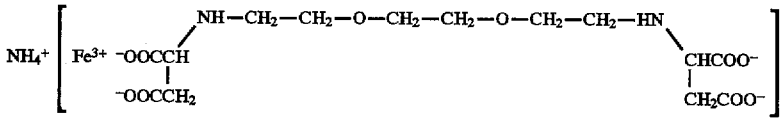

K-10

The processing solution capable of bleaching a silver halide color photographic material in accordance with a preferred embodiment of the present invention, is preferably used to bleach a color-developed, imagewise-exposed photographic material.

Examples of the processing solutions (compositions) in accordance with the present invention include a bleaching solution (composition) and a blix solution (composition).

The processing composition may be in the form of a powder to be used as a kit, or in the form of an aqueous solution such as a processing solution for use directly in the processing step or as a replenisher. When in the form of a kit, water is added to prepare a processing or replenishing solution.

The ferric complex salt may be introduced into the processing solution having a bleaching capacity by dissolving into the system a previously formed iron complex. Alternatively, a complexing compound and a ferric salt (e.g., ferric sulfate, ferric chloride, ferric bromide, ferric nitrate (III), ferric ammonium sulfate (III)) may be present together in the processing solution having a bleaching capacity so that a complex salt is formed therein (in situ).

The complexing compound may be used in slight excess of the amount required for complexing with ferric ion. The excess, if any, is preferably in the range of 0.01 to 10 mol %.

Of the ferric complex salts contained in the processing solution (complex) of the present invention having a bleaching capacity, preferably about 50 mol % or more, more preferably 80 mol % or more are ferric complex salts of the compound represented by formula (I).

In the present invention, the processing solution (complex) having a bleaching capacity of the present invention can contain a single type of ferric complex salt of the compound represented by formula (I), or may contain two or more types of ferric complex salts of the compound represented by formula (I).

Furthermore, compounds which form a ferric complex salt bleaching agent other than these represented by formula (I) can also be contained in the processing solution having a bleaching capacity, to the extent that the objectives of this invention are achieved. Examples of such compounds include EDTA, 1,3-PDTA, diethylenetriaminepentaacetic acid, 1,2-cyclohexanediaminetetraacetic acid, iminodiacetic acid, methyliminodiacetic acid, N-(2-acetamide)-iminoacetic acid, nitrilotriacetic acid, N-(2-carboxyethyl) iminodiacetic acid, and N-(2-carboxymethyl)iminodipropionic acid.

In the present invention, an inorganic oxidizer as a bleaching agent can be incorporated into the processing solution having a bleaching capacity in combination with the aforementioned ferric complex salts. Examples of the inorganic oxidizer include hydrogen peroxide, persulfate, and bromate in an amount of preferably 0.01 to 1.0 mol/l, more preferably 0.05 to 0.5 mol/l.

The concentration of the ferric (III) complex salt of the compound represented by formula (I) in the processing solution of the present invention having a bleaching capacity is in the range of from 0.003 to 1.0 mol/l, preferably from 0.02 to 0.50 mol/l, more preferably from 0.05 to 0.40 mol/l. If the aforementioned inorganic oxidizer is used in combination with the ferric complex salt, the concentration of the ferric complex salt of the compound represented by formula (I) in the processing solution is preferably in the range of from 0.005 to 0.030 mol/l.

In addition to the ferric complex salt of the compound of formula (I) as a bleaching agent, the processing solution having a bleaching capacity of the present invention preferably contains a halide such as chloride, bromide and iodide as a re-halogenating agent for accelerating the oxidation of silver. In place of such a halide, an organic ligand which forms a sparingly soluble silver salt may be added. The halide is added in the form of an ammonium salt or a salt of guanidine or an amine. Specific examples of such a salt include sodium bromide, potassium bromide, ammonium bromide, potassium chloride, and guanidine hydrochloride.

Nitrate is preferably added to the processing solution having a bleaching capacity as a corrosion inhibitor. Examples of the nitrate include ammonium nitrate, sodium nitrate, and potassium nitrate. The addition amount of the nitrate is in the range of from 0.01 to 2.0 mol/l, preferably from 0.05 to 0.5 mol/l.

The bromide ion concentration of the bleaching solution of the present invention is preferably in the range of 1.8 mol/l or less, more preferably from 0.1 to 1.6 mol/l. If the aforementioned inorganic oxidizer is also present, the bromide ion concentration is preferably in the range of from 0.05 to 0.10 mol/l.

Bromide ion may also be contained in the blix solution of the present invention. The addition amount of bromide ion is preferably in the range of 1.0 to 0.1 mol/l.

In the present invention, useful cations for pairing with bromide ion include ammonium ion, sodium ion, potassium ion, etc. Among these cations, ammonium ion is preferably used to promote rapid processing. On the other hand, if emphasis is placed on environmental protection, the system is preferably substantially free of ammonium ion.

The term "substantially free of ammonium ion" as used herein means an ammonium ion concentration of 0.1 mol/l or less, preferably 0.08 mol/l or less, more preferably 0.01 mol/l or less, particularly none.

In order to obtain the above specified ammonium ion concentration range, alkaline metal ions are preferred as substitute cations. In particular, sodium ion, potassium ion, etc. are preferred. Specific examples of the source of such alkaline metal ions include sodium salt and potassium salt as contained in the ferric complex salt of a constituent aminopolycarboxylic acid bleaching agent, potassium bromide and sodium bromide as a constituent re-halogenating agent in a bleaching solution, and potassium nitrate and sodium nitrate included as corrosion inhibitors.

Alkaline agents for pH adjustment of the processing solution of the invention include potassium hydroxide, sodium hydroxide, potassium carbonate, sodium carbonate or the like.

The bleaching solution of the present invention preferably has a pH of from 3.0 to 7.0, particularly from 3.5 to 6.5. On the other hand, the blix (bleach-fixing) solution of the present invention preferably has a pH of from 3.0 to 8.0, more preferably from 4.0 to 7.5.

In order to adjust the processing solution having a bleaching capacity of the present invention to the above specified pH range, known organic acids can be used.

In the present invention, the processing solution having a bleaching capacity may contain an organic acid having a pKa value of from 2.0 to 5.5 in an amount of from 0.1 to 1.2 mol/l as attaining a buffer function to control ,pH change of the solution.

In the present invention, pKa represents the logarithm of the reciprocal of the acid dissociation constant determined at an ionic strength of 0.1 mol/l and a temperature of 25° C.

The organic acid having a pKa value of 2.0 to 5.5 for use in the present invention may be a monobasic acid or polybasic acid. In the case of polybasic acid, if its pKa value is in the above specified range, it may be used in the form of a metallic salt (e.g., sodium salt, potassium salt) or ammonium salt. Two or more organic acids having a pKa value falling within the above specified range may be used in admixture.

Specific preferred examples of the organic acid having a pKa value of 2.0 to 5.5 for use in the present invention include aliphatic monobasic acids such as formic acid, acetic acid, monochloroacetic acid, mono-bromoacetic acid, glycolic acid, propionic acid, mono-chloropropionic acid, lactic acid, pyruvic acid, acrylic acid, butyric acid, isobutyric acid, pivalic acid, aminobutyric acid and isovaleric acid; amino acid compounds such as asparagin, alanine, arginine, ethionine, glycine, glutamine, cysteine, serine, methionine and leucine; aromatic monobasic acids such as monosubstituted benzoic acid (e.g., benzoic acid, chloro-substituted benzoic acid, hydroxy-substituted benzoic acid) and nicotinic acid; aliphatic dibasic acids such as oxalic acid, malonic acid, succinic acid, tartaric acid, malic acid, maleic acid, fumaric acid, oxalacetic acid, glutaric acid and adipic acid; amino dibasic acids such as aspartic acid, glutamic acid, cystine and ascorbic acid; aromatic dibasic acids such as phthalic acid and terephthalic acid; and polybasic acids such as citric acid.

Among these organic acids, acetic acid, glycolic acid and lactic acid are preferably used in the present invention. In particular, acetic acid and glycolic acid are preferred.

The replenishment rate in continuous processing of the processing solution having a bleaching capacity is preferably from 20 to 1,000 ml, preferably from 30 to 800 ml, more preferably from 40 to 750 ml per $m^2$ of light-sensitive material processed.

Specific examples of desilver-processing procedures providing a bleaching function for use in the present invention include the following:

Blix
Bleach—fixing
Bleach—rinse—fixing
Bleach—blix
Bleach—rinse—blix
Bleach—blix—fixing The fixing agent for addition to the fixing solution or blix solution includes, for example, thiosulfate such as sodium thiosulfate, ammonium thiosulfate, ammonium sodium thiosulfate and potassium thiosulfate, thiocyanate (rhodan salt) such as sodium thiocyanate, ammonium thiocyanate and potassium thiocyanate, thiourea, thioether or the like.

If the fixing agent consists of a thiosulfate only, the addition amount thereof is from 0.3 to 3 mols, preferably from 0.5 to 2 mols per l of fixing solution or blix solution. If a thiocyanate is used singly, the addition amount thereof is from 1 to 4 mols per l of fixing solution or blix solution. The amount of the fixing agent or fixing agents when used in combination is in the range of from 0.3 to 5 mols, preferably from 0.5 to 3.5 mols per l of fixing solution or blix solution. If such fixing agents are used in combination, the total amount thereof may fall within the above specified range.

Examples of compounds other than thiocyanates for use in combination with thiosulfates as fixing agents include thiourea and thioether (e.g., 3,6-dithia-1,8-octanediol).

The fixing solution or blix solution may contain a sulfite (e.g., sodium sulfite, potassium sulfite, ammonium sulfite), hydroxylamine, hydrazine, bisulfite addition products of an acetaldehyde compound (e.g., sodium acetaldehyde bisulfite). etc. as a preservative. The fixing solution or blix solution may further contain various fluorescent brightening agents, anti-foaming agents or surface active agents or organic solvents such as polyvinylpyrrolidone and methanol. In particular, the sulfinic compounds as disclosed in JP-A-60-283881 are preferably used.

The pH value of the fixing solution is preferably in the range of from 5 to 9, more preferably from 6.5 to 8. In order to adjust the processing solution having a fixing capacity (the fixing solution or the blix solution) to the above specified pH range, the processing solution may contain a compound having a pKa value falling within the range of from 6 to 9 as a buffer.

Compounds represented by formula (B) indicated below are preferred in the present invention as compounds having a pKa value in the range of from 6.0 to 9.0.

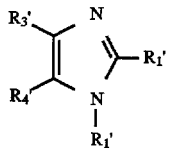

(B)

wherein $R_1'$, $R_2'$, $R_3'$ and $R_4'$ each individually represents a hydrogen atom, an alkyl group or an alkenyl group.

The alkyl groups preferably have from 1 to 5 carbon atoms, and more preferably 1 or 2 carbon atoms, and they may have substituent groups, such as a hydroxy group, an amino group, a nitro group, for example. Of these alkyl groups, those which are unsubstituted are preferred, and methyl and ethyl groups are examples of the preferred groups.

The alkenyl groups preferably have from 2 to 5 carbon atoms, and more preferably 2 or 3 carbon atoms, and they may have the above mentioned substituent groups. Of these groups, the unsubstituted groups are preferred, and examples include the vinyl and allyl groups.

Among the above mentioned compounds in the present invention, $R_1'$ to $R_4'$ preferably represent hydrogen atoms or unsubstituted alkyl groups which have 1 or 2 carbon atoms. When there are alkyl groups present, the case in which any one of $R_1'$ to $R_4'$ is an alkyl group is preferred, and the case in which all of $R_1'$ to $R_4'$ are hydrogen atoms is the most preferred.

Actual examples of compounds which can be represented by formula (B) are indicated bellow, but the compounds are not limited to these examples.

(1) Imidazole
(2) 1-Methylimidazole
(3) 2-Methylimidazole
(4) 4-Methylimidazole
(5) 4-Hydroxymethylimidazole
(6) 1-Ethylimidazole
(7) 1-Vinylimidazole
(8) 4-Aminomethylimidazole
(9) 2,4-Dimethylimidazole
(10) 2,4,5-Trimethylimidazole
(11) 2-Aminoethylimidazole
(12) 2-Nitroethylimidazole Compounds represented by formula (B) (imidazole compounds) are available commercially, and these compounds can be used as they are without further treatment in the present invention.

Typical examples of other compounds which have a pKa value of from 6.0 to 9.0 are indicated bellow.

B-1 3-[(Biscyclohexylmethyl)methylamino]propylbenzene
B-2 N-(2,2-Diphenylethyl)benzylamine
B-3 4,4-Bisdiethylaminotriphenylcarbinol
B-4 Aziridine
B-5 Octahydro-1-(1-methyl-3,3-diethyl)prop-2-enylazoine
B-6 1-tert-Butyl-octahydro-5-hydroxy-6-oxo-azonine
B-7 1-[2,3-(Albailido)propyl]piperidine
B-8 2-Acetylimino-1,2-dihydroxy-1-methylpyridine
B-9 2-Bromo-5-sulfanilimidopyridine
B-10 1-Methyl-2-(3-pyridyl)pyrrolidine
B-11 2-Benzyl-2-pyrroline
B-12 2-Cyclohexyl-2-pyrroline
B-13 2-Ethyl-2-pyrroline
B-14 N-Acylmorpholine
B-15 N-[2-(Bis-2-hydroxypropylaminoethyl)]morpholine
B-16 N-(3,3-Diphenyl-3-propylcarbonyl)morpholine
B-17 N-(3-Ehylcarbonyl-2-methyl-3,3-diphenyl) propylmorpholine
B-18 N-Methylmorpholine
B-19 N-(3-Morpholino)propylmorpholine
B-20 1-Benzolylpiperazine
B-21 1,4-Bis(2-hydroxypropyl)piperazine
B-22 1-Ethoxycarbonyl-4-methylpiperazine
B-23 1-(p-Toluene)sulfonylpiperazine
B-24 4-Amino-5-aminomethyl-2-methylpiperazine
B-25 5-Amino-4-carboxy-6-carboxymethylamino-2-ethoxypyrimidine
B-26 5-Amino-4-(1-carboxyethylidene)iminopyrimidine
B-27 4-Amino-2,3-dihydroxymethyl-2-oxopyrimidine
B-28 4-Amino-2-dihydroxy-5-nitropyrimidine
B-29 4-Amino-2-methylaminopyrimidine
B-30 5-Bromo-2,4-dihydroxypyrimidine
B-31 2,4-Diaminopyrimidine
B-32 2,4-Diamino-6-methylpyrimidine
B-33 4,5-Dihydroxy-2-methyl-1,3-triazine
B-34 2-(p-Amino)benzenesulfonamidotriazole
B-35 3-Ethyl-2,3-dihydro-2-imido-5-phenyl-1,3,4-triazole
B-36 3-Ethyl-2-ethylamino-2,3-dihydro-5-phenyl-1,3,4-triazole
B-37 2-Aminoquinoline Of course, this type of compound is not limited by these examples. Those of these compounds which have a pKa value within the range from 6.7 to 8.0 are preferred.

Preferred examples of such a compound include imidazoles such as imidazole and 2-methyl-imidazole. The addition amount of the buffer is preferably from 0.1 to 10 mol, preferably from 0.1 to 3 mol, per l of processing solution.

The replenishment rate of the fixing solution in continuous processing is preferably in the range of 3,000 ml or less, more preferably from 200 to 1,000 ml per $m^2$ of light-sensitive material processed.

The fixing solution may preferably contain various aminopolycarboxylic acids or organic phosphonic acids for stabilizing the solution.

In the present invention, the processing solution having a bleaching capacity or its prebath may contain various bleach accelerators.

Examples of useful bleach accelerators include compounds containing a mercapto group or disulfide group as disclosed in U.S. Pat. No. 3,893,858, German Patent 1,290,812, British Patent 1,138,842, JP-A-53-95630 (the term "JP-A" as used herein means an "unexamined published Japanese patent application"), and Research Disclosure No. 17129 (July 1978), thiazolidine derivatives as disclosed in JP-A-50-140129, thiourea derivatives as disclosed in U.S. Pat. No. 3,706,561, iodides as disclosed in JP-A-58-16235, polyethylene oxides as disclosed in German Patent 2,748,430, and polyamine compounds as disclosed in JP-B-45-8836 (The term "JP-B" as used herein means an "examined Japanese patent publication"). Particularly preferred among these bleach accelerators are mercapto compounds as disclosed in British Patent 1,138,842.

The processing time for processing using the processing solution of the present invention having a bleaching capacity is preferably 4 minutes or less, more preferably 15 seconds to 4 minutes, the most preferably 30 seconds to 3 minutes.

The processing solution having a bleaching capacity of the present invention is preferably aerated during processing. Aeration can be accomplished by means known in the art. For example, air may be blown into the bleaching solution, or an ejector may be used to allow the bleaching solution to absorb air.

In order to blow air into the bleaching solution, air is preferably released into the solution through an air diffuser pipe having micropores. Such an air diffuser pipe is widely used in aeration tanks for active sludge disposal.

For aeration, reference can be made to "Using Process C-41" 3rd ed., Z-121, Eastman Kodak, pp BL-1 to BL-2, 1982.

In processing with the processing solution having a bleaching capacity of the present invention, agitation is preferably intensified. For agitation means, reference can be made to JP-A-3-33847, line 6, upper right column-line 2, lower left column, page 8. Particularly preferred among agitation means is a jet process in which a bleaching solution is blown against the emulsion surface of a light-sensitive material.

The processing temperature is not particularly limited. Preferably, it is in the range of 25° to 50° C., particularly 35° to 45° C.

The overflow solution from the bleaching solution after use may be recovered, provided with necessary components to correct the composition thereof, and then re-used as a bleaching solution. Such recovery and reuse is generally referred to as "regeneration". In the present invention, a regenerated processing solution may be preferably used. For the details of regeneration, reference can be made to "Fuji Film Processing Manual: Fuji Color Negative Film CN-16 Processing", revised in August 1990, Fuji Photo Film Co., Ltd., pp. 39–40.

The kit from which the bleaching solution of the present invention is prepared may be in the form of a liquid or powder. If an ammonium salt is excluded, most starting materials are supplied in the form of a powder and the system exhibits little moisture absorption, thereby facilitating preparation of a powder.

The aforementioned kit for regeneration is preferably in the form of a powder that cab be added to the system as is without also adding extra water, to thereby reduce the amount of waste liquid.

The regeneration of the bleaching solution can be accomplished by the aforementioned aeration as well as by the methods disclosed in "Shashin Kogaku no Kisoginen shashinhen (Fundamental knowledge of photographic engineering: Silver salt system photography)", edited by Society of Photographic Science and Technology of Japan, published by Corona Co., Ltd., 1979. Specific examples of these regeneration methods include electrolytic regeneration, and regeneration of a bleaching solution with hydrogen peroxide, bromous acid, ozone, etc. using bromic acid, chlorous acid, bromine, bromine precursor, persulfate, hydrogen peroxide, catalyst, etc. However, the present invention is not limited thereto.

In the electrolytic regeneration method, a cathode and an anode may be installed in the same bleaching bath. Alternatively, a cathodic bath and an anodic bath may be partitioned by a diaphragm so that regeneration is conducted in a separate bath system. Furthermore, by using a diaphragm, the bleaching solution or the developer or fixing solution may be simultaneously regenerated.

The color developer for use in the present invention preferably includes those disclosed in JP-A-3-33847, line 6, upper left column, page 9 to line 6, lower left column, page 11.

Specific examples of such color developers for use in the present invention include Type CN-16, CN-16X, CN-16Q and CN-16FA color developers or color developer replenishers as color negative film processing agents available from Fuji Photo Film Co., Ltd., and Type C-41, C-41B and C-41RA color developers as color negative film processing agents available from Eastman Kodak.

According to the present invention, when a color reversal treatment takes place, a black-and-white development, a water washing, a reversal treatment and etc. are carried out prior to bleaching. A preferred black-and-white developing solution and reversal treatment are disclosed in JP-A-4-34548, from page 7, upper right column, line 1 to page 8, lower left column, line 9.

The amount of replenisher for the black-and-white developing solution is preferably from 50 ml to 2500 ml per $m^2$ of the photosensitive material processed, more preferably from 100 ml to 1500 ml.

In the fixing or blix procedure, agitation is preferably intensified in a manner similar to the bleaching procedure. In particular, the aforementioned jet agitation process is most preferred.

Silver can be removed from the fixing solution or blix solution by known methods to reduce the replenishment rate or to regenerate the processing solution.

For the rinse and stabilization procedures to be effected in the present invention, reference can be similarly made to JP-A-3-33847, line 9, lower right column, page 11 to line 19, upper right column, page 12.

The stabilizing solution has heretofore typically comprised formaldehyde as a stabilizing agent. From the standpoint of safety in the work area, triazole derivatives such as N-methylolpyrazole, hexamethylenetetramine, formaldehyde-bisulfurous acid addition product, dimethylol urea and 1,4-bis(1,2,4-triazole-1-ilmethyl) piperazine are preferably used. Among these stabilizing agents, N-methylolpyrazole, which is obtained by the reaction of formaldehyde and pyrazole, and triazole such as 1,2,4-triazole and azolylmethylamine derivative such as 1,4-bis (1,2,4-triazole-1-ilmethyl) piperazine are advantageously used in combination to provide high image stability and to reduce formaldehyde vapor pressure (as described in EP 519190A2).

The present invention is effectively used for bleaching various color photographic materials such as color negative film, color reversal film, color paper, color reversal paper, color negative film for motion picture and color positive film for motion picture. For example, the present invention is preferably used for processing the photographic materials described in JP-A-3-33847, line 29, upper right column, page 12 to line 17, upper right column, page 17, and EP 519190A2.

In particular, the present invention is preferably applied to processing a photographic material having a dry thickness of 20 μm or less, particularly 12 to 18 μm or less, to thereby provide for good desilvering properties.

The specification of film thickness is made because of the color developing agent take-up by these layers of a color photosensitive material during and after development and because of the considerable effect due to the amount of residual color developing agent on bleaching fog and the staining which occurs during image storage after processing. In particular, the occurrence of bleaching fog and staining is due to the fact that the increase in coloration of the magenta color which is thought to be due to the green-sensitive color layer is greater than the increase in coloration of the cyan and yellow colors.

Moreover, the lower limiting value for the film thickness is not subject to any particular limitation provided that the function of the sensitive material is not effectively outside the above mentioned definition but the lower limiting value for the total dry film thickness of the structural layers other than the support and the subbing layer of the support in the sensitive material is preferably 12.0 μm, and the lower limiting value for the total dry film thickness of the structural layer which is established between the photosensitive layer which is located closest to the support and the subbing layer of the support is preferably 1.0 μm.

Furthermore, reduction of the layer thickness can be achieved with the photosensitive layers or the non-photosensitive layers.

The film thickness of a multilayer color photosensitive material in the present invention is measured using the method indicated below.

The sensitive material which is to be measured is stored for 7 days after preparation under conditions of 25° C., 50% RH. First of all, the total thickness of the sensitive material is measured and then the thickness is measured again after removing the coated layers from the support and the difference is taken to be the total film thickness of the coated layers except for the support of the aforementioned sensitive material. The measurement of this thickness can be achieved using a film thickness gauge of the contact type with a voltage conversion element, for example (Anritsu Electric Co., Ltd., K-402B Stand.). Moreover, the removal of the coated layer on the support can be achieved using an aqueous solution of sodium hypochlorite.

Next, a cross sectional photograph of the above mentioned sensitive material is taken using a scanning electron microscope (magnification preferably at least 3,000 times), the total thickness and the thickness of each layer on the support is measured and the thickness of each layer can then be calculated as a proportion of the measured value of the total thickness obtained before-hand with the film thickness gauge (the absolute value of the thickness as measured).

Furthermore, the photographic materials processed in accordance with the present invention preferably have a high swelling rate. The swelling factor [(Equilibrium swelled film thickness in water at 25° C.—Total dry film thickness at 25° C., 55% RH/Total dry film thickness at 25° C., 55% RH)× 100] of the sensitive material in the present invention is preferably from 50 to 200%, and more preferably from 70 to 150%. If the swelling factor is outside the range of numerical values indicated above the amount of residual color developing agent increases and there is an adverse effect on image quality such as photographic property an desilvering properties, and on the physical properties of the film such as the film strength.

Moreover, the film swelling rate T½ of a sensitive material in the present invention is defined as the time taken for the film thickness to reach half of the film thickness observed when 90% of the maximum swelled film thickness which is reached on processing for 3 minutes 15 seconds in color developer (38° C.) is taken to be the saturation film thickness T½ is preferably not more than 15 seconds, and more preferably not more than 9 seconds.

The photosensitive materials of the present invention should have established on a support at least one blue-sensitive layer, at least one green-sensitive layer and at least one red-sensitive layer, but no particular limitation is imposed upon the number or order or the silver halide emulsion layers and non-photosensitive layers. Typically, they are silver halide photographic materials which have, on a support, a photosensitive layer comprised of a plurality of silver halide layers which have essentially the same color sensitivity but different photographic speeds, the photosensitive layer being a unit photosensitive layer which is color-sensitive to blue light, green light or red light, and in multilayer silver halide color photographic materials, the arrangement of the unit photosensitive layers generally involves the establishment of the layers in the order, from the support side, of red-sensitive layer, green-sensitive layer, blue-sensitive layer. However, this order may be reversed, if desired, and the layers may be arranged in such a way that a layer which has a different color sensitivity is sandwiched between layers which have the same color sensitivity.

Various non-photosensitive layers, such as intermediate layers, may be established between the photosensitive silver halide layers, and uppermost and lowermost layers.

The intermediate layers may contain couplers and DIR compounds such as those disclosed in JP-A-61-43748, JP-A-59-113438, JP-A-59-113440, JP-A-61-20037 and JP-A-61-20038, and they may also contain the generally used anti-color-mixing agents, ultraviolet absorbers and antistaining agents.

The plurality of silver halide emulsion layers constituting each unit photosensitive layer is preferably a double layer structure comprising a high speed emulsion layer and a low speed emulsion layer as disclosed in West German Patent 1,121,470 or British Patent 923,045. Generally, arrangement in which the photographic speed is lower in the layer closer to the support are preferred, and non-photosensitive layers may be established between each of the silver halide emulsion layers. Furthermore, the low speed emulsion layers may be arranged on the side furthest away from the support and the high speed emulsion layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL), or BH/BL/GL/GH/RH/RL, or BH/BL/GH/GL/RL/RH.

Furthermore, the layers may be arranged in the order, from the side furthest from the support, of blue-sensitive layer/GH/RL/GL/RL as disclosed in JP-B-55-34932. Furthermore, the layers may also be arranged in the order, from the side furthest away from the support, of blue-sensitive layer/GL/RL/GH/RH, as disclosed in JP-A-56-25738 and JP-A-62-63936.

Furthermore, arrangements in which there are three layers, which have different speeds with the speed falling towards the support with the highest speed silver halide emulsion layer at the top, a silver halide emulsion layer which has a lower speed than the aforementioned layer as an intermediate layer and a silver halide emulsion layer which has a lower speed than the intermediate layer as a bottom layer, as disclosed in JP-B-49-15495, can also be used. In the case of structures of this type which have three layers with different speeds, the layers in a layer of the same color sensitivity may be arranged in the order, from the side furthest from the support, of intermediate speed emulsion layer/high speed emulsion layer/low speed emulsion layer, as disclosed in JP-A-59-202464.

Various layer structures and arrangements can be selected according to the purpose of the respective sensitive materials in the way described above.

All of these layer arrangements can be used in color photosensitive materials in the present invention, but color photosensitive materials of which the dry film thickness of all the structural layers except the support, the subbing layer of the support and the backing layer is not more than 20.0 μm is preferred for realizing the aims of the present invention. A dry film thickness as described above of not more than 18.0 μm is especially preferred.

The preferred silver halides included in the photographic emulsion layers of a color photosensitive material which is used in the present invention are at least one of silver iodobromides, silver iodochlorides and silver iodochlorobromides which contain 30 mol % or lower of silver iodide. Most preferably they are silver iodobromides which contain from about 2 mol % to about 25 mol % of silver iodide.

The silver halide grains in the photographic emulsion may have a regular crystalline form such as a cubic, octahedral or tetradecahedral form, an irregular crystalline form such as a spherical or tabular form, a form which has crystal defects such as twinned crystal planes, or a form which is a composite of these forms.

The grain of the silver halide may be a very fine grain having a diameter of about 0.2 μm, or a large grain having a projected area diameter of up to about 10 μm, and the emulsion may be polydisperse emulsions or monodisperse emulsions.

The photographic emulsions which can be used in the present invention can be prepared, for example, using the methods disclosed in *Research Disclosure* (*RD*), No. 17643 (December, 1978), pages 22 and 23, "I. Emulsion Preparation and Types", and *Research Disclosure,* No. 18716 (November, 1979), page 648, by P. Glafkides in *Chimie et Physique Photographique,* published by Paul Montel, 1967, by G. F. Duffin in *Photoraphic Emulsion Chemistry*, published by Focal Press, 1966, and by V. L. Zelikman et al., in *Making and Coating Photographic Emulsions*, published by Focal Press, 1964.

The monodispersions disclosed, for example, in U.S. Pat. Nos. 3,574,628 and 3,655,394, and British Patent 1,413,748 are also preferred.

Furthermore, tabular grains which have an aspect ratio of at least about 5 can be used in the present invention. Tabular grains can be prepared easily using the methods described, for example, by Gutoff in *Photographic Science and Engineering,* Vol. 14, pages 248 to 257 (1970), and in U.S. Pat. Nos. 4,343,226, 4,414,310, 4,430,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example.

Furthermore, mixtures of grains which have various crystalline forms can be used.

The silver halide emulsions used have generally been subjected to physical ripening, chemical ripening and spectral sensitization. Additives which are used in such processes have been disclosed in *Research Disclosure*, Nos. 17643 and 18716, and the locations or these disclosures are summarized in the table below.

| Additives | RD 17643 (December. 1978) | RD 18716 (November. 1979) |
|---|---|---|
| 1. Chemical Sensitizers | Page 23 | Page 648, right column |
| 2. Sensitivity Increasing Agent | — | " |
| 3. Spectral Sensitizers and Supersensitizers | Pages 23–24 | Page 648, right column to page 649, right column |
| 4. Brightening Agents | Page 24 | Page 647, right column |
| 5. Antifoggants and Stabilizers | Pages 24–25 | Page 649, right column |
| 6. Light Absorbers, Filter Dyes and Ultraviolet Absorbers | Pages 25–26 | Page 649, right column to page 650, left column |
| 7. Antistaining Agents | Page 25, right column | Page 650, left to right columns |
| 8. Dye Image Stabilizers | Page 25 | Page 650, left column |
| 9. Hardeners | Page 26 | Page 651, left column |
| 10. Binders | Page 26 | " |
| 11. Plasticizers and Lubricants | Page 27 | Page 650, right column |
| 12. Coating Aids and Surfactants | Pages 26–27 | " |
| 13. Antistatic Agents | Page 27 | " |

Various color couplers can be used in the present invention, and actual examples have been disclosed in the patents cited in the aforementioned *Research Disclosure* (*RD*), No. 17643, sections VII-C to G.

Those disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds ad pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,064, *Research Disclosure*, No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO (PCT) 88/04795 are especially preferred.

Phenol and naphthol based couplers are used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A U.S. Pat. Nos. 3,446,622, 4,333,999, 4,743,871, 4,451,559, 4,427,767, 4,690,889, 4,254,212 and 4,296,199, and JP-A-61-42658 are preferred.

The colored couplers for correcting the unwanted absorptions of colored dyes disclosed, for example, in section VII-G of *Research Disclosure,* No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent disclosed in U.S. Pat. No. 4,777,120 is also preferred.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

Typical examples of polymerized dye forming couplers have been disclosed, for example, in U.S. Pat. Nos. 3,451,820, 4,080,211, 4,367,282, 4,409,320 and 4,576,910, and British Patent 2,102,173.

The use of couplers which release photographically useful residual groups on coupling is preferred in the present invention. The DIR couplers which release development inhibitors disclosed in the patents cited in section VII-F of the aforementioned *Research Disclosure, No.* 17643, JP-A-57-151944, JP-A-57-154234, JP-A-60-184248, JP-A-63-37346, and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or developing accelerators in the form of the image during development.

Other compounds which can be used in photosensitive materials of the present invention include the competitive couplers disclosed, for example, in U.S. Pat. No. 4,130,427; the multiequivalent couplers disclosed, for example, in U.S. Pat. Nos. 4,283,472, 4,338,393 and 4,310,618; the DIR redox compounds releasing couplers, DIR coupler releasing couplers, DIR coupler releasing redox compounds or DIR redox releasing redox compounds disclosed, for example, in JP-A-60-185950 an JP-A-62-24252. the couplers which release dyes of which the color is restored after elimination disclosed in European Patent 173,302A, the bleaching accelerator releasing couplers disclosed, for example, in Research Disclosure, No. 11449, ibid., No. 24241, and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The couplers which are used in the present invention can be introduced into the photosensitive material using various known methods of dispersion.

Examples of high boiling point solvents which can be used in the oil-in-water dispersion method have been disclosed, for example, in U.S. Pat. No. 2,322,027, and actual examples of high boiling point organic solvents which have a boiling point of at least.175° C. at normal pressure which can be used in the oil-in-water dispersion method include phthalic acid esters (for example, dibutyl, phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate and bis(1,1-diethylpropyl) phthalate), phosphate or phosphonate esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoic acid esters (for example, 2-ethylhexyl benzoate, dodecyl benzoate and 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenyl), aliphatic carboxylic acid esters (for example, bis(2-ethylhexyl)sebacate, dioctyl azelate, glycerol tributyrate, isostearyl lactate and trioctyl citrate), aniline derivatives (for example, N,N-dibutyl-2-butoxy-5-tert-octylaniline) and hydrocarbons (for example, paraffins, dodecylbenzene and diisopropylnaphthalene). Furthermore, organic solvents which have a boiling point of at least about 30° C., and preferably of at least 50° C., but below about 160° C., can be generally used as auxiliary solvents, and typical examples of these solvents include ethyl acetate, butyl acetate, ethyl propionate, methyl ethyl ketone, cyclohexanone, 2-ethoxyethyl acetate and dimethylformamide.

Actual examples of the processes and effects of the latex dispersion method and of latexes for loading purposes have been disclosed, for example, in U.S. Pat. No. 4,199,363, and West German Patent Application (OLS) Nos. 2,541,274 and 2,541,230.

Furthermore, these couplers can be impregnated onto a loadable latex in the presence or absence of the aforementioned high boiling point organic solvents (for example, U.S. Pat. No. 4,203,716), or they can be dissolved in a water-insoluble but organic solvent-soluble polymer and emulsified and dispersed in an aqueous hydrophilic colloid solution.

Furthermore, use of the homopolymers or co-polymers disclosed on pages 12 to 30 of the specification of International Patent WO88/00723 is preferred. The use of acrylamide based polymers is especially preferred from the viewpoint of dye stabilization.

Various color photosensitive materials can be used in the present invention. The application of the present invention to general purpose and cinematographic color negative films and color reversal films for slides and television purposes is especially preferred.

Suitable supports which can be used in the present invention have been described on page 28 of *Research Disclosure,* No. 17643 and from the right hand column on page 647 to the left hand column of page 648 of *Research Disclosure,* No. 18716.

A support for a color negative film for processing in accordance-with the present invention preferably has an electroconductive layer on one side and a transparent magnetic layer on the opposite side as shown in JP-A-4-62543, or a magnetic recording layer as shown in FIG. 1A of the international patent publication gazette WO 90/04205, and a stripe magnetic recording layer disclosed in JP-A-4-124628 together with an adjacent transparent magnetic recording layer. Futhermore, a protective layer as disclosed in JP-A-4-73737 is preferably provided over these magnetic recording layers.

The support preferably has a thickness of from 70 μm to 130 μm. The various types of plastic films, disclosed in JP-A-4-124636, page 5, right upper column, line 1 to page 6, right upper column, line 6 may, be used as a material for the support. Preferred are cellulose derivatives, for example, diacetyl-, triacetyl-, propionyl-, butanoyl- and acetylpropionylacetate, the polyesters disclosed in JP-B-48-40414, for example, polyethylenephthalate, poly-1,4-cyclohexane dimethylene phthalate and polyethylenenaphthalate. The support for a film for processing in accordance with the present invention is preferably made of polyester due to less adhesional wetting with coating solution.

A patorone in which a negative color film of the present invention is enveloped is not particularly restricted. Conventional or known patrones may be used, and particularly, those disclosed in FIGS. 1 to 3 of U.S. Pat. No. 4,834,306, or FIGS. 1 to 3 of U.S. Pat. No. 4,846,418 are preferred.

Besides these, a preferred negative color film for processing in accordance with the the present invention is disclosed in JP-A-4-125558, page 14, left upper column, line 1 to page 18, left lower column, line 11.

In addition to ferric complex salts (III) of the compound represented by formula (I), the processing solution having a bleaching capacity may contain Mn (III) complex salts, Co(III) complex salts, Rh(II) complex salts, Rh(III) complex salts, Au(II) complex salts, Au(III) complex salts or Ce(IV) complex salts of the compound represented by formula (I), to the extent that the effects of the present invention are obtained.

Solutions of these heavy metal complex salts, including ferric complex salts, may be used as bleaching or blix compositions, as well as processing compositions for treatment of black-and-white films after development and fixing such as intensifier, reducer and toner compositions.

The present invention is further described in the following Examples, but the present invention should not be construed as being limited thereto.

EXAMPLE 1

A multi-layer color light-sensitive material was prepared as Specimen 101 by coating on an undercoated cellulose triacetate film support various layers having the following compositions:

(Composition of light-sensitive layer)

Materials to be incorporated in the various layers are classified into the following categories:

ExC: cyan coupler;

ExM: magenta coupler;

ExY: yellow coupler;

ExS: sensitizing dye;

UV: ultraviolet absorbent;

HBS: high boiling organic solvent;

H: gelatin hardener

The coated amount of the various components is represented in g/m$^2$. The coated amount of colloidal silver is represented in g/m$^2$ in terms of silver content. The coated amount of sensitizing dye is represented in the number of moles per mole of silver halide in the same layer.

| (Sample 101) | | |
|---|---|---|
| 1st layer: (antihaltion layer) | | |
| Black colloidal silver | in terms of silver | 0.18 |
| Gelatin | | 1.40 |
| ExM-1 | | 0.18 |
| ExF-1 | | $2.0 \times 10^{-3}$ |
| HBS-1 | | 2.0 |
| 2nd layer: (interlayer) | | |
| AgBrI Emulsion G | in terms of silver | 0.065 |
| 2,5-Di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| 3rd layer: (low sensitivity red-sensitive emulsion layer) | | |
| AgBrI Emulsion A | in terms of silver | 0.25 |
| AgBrI Emulsion B | in terms of silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |
| Cpd-2 | | 0.025 |
| HBS-1 | | 0.10 |
| Gelatin | | 0.87 |
| 4th layer: (middle sensitivity red-sensitive emulsion layer) | | |
| AgBrI Emulsion D | in terms of silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |
| 5th layer: (high sensitivity red-sensitive emulsion layer) | | |
| AgBrI Emulsion E | in terms of silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |
| 6th layer: (interlayer) | | |
| Cpd-1 | | 0.10 |
| HBS-1 | | 0.50 |
| Gelatin | | 1.10 |
| 7th layer: (low sensitivity green-sensitive emulsion layer) | | |
| AgBrI Emulsion C | in terms of silver | 0.35 |
| ExS-4 | | $3.0 \times 10^{-5}$ |
| ExS-5 | | $2.1 \times 10^{-4}$ |

-continued (Sample 101)

| | | |
|---|---|---|
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer: (middle sensitivity green-sensitive emulsion layer) | | |
| AgBrI Emulsion D | in terms of silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |
| Gelatin | | 0.90 |
| 9th layer: (high sensitivity green-sensitive emulsion layer) | | |
| AgBrI Emulsion E | in terms of silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |
| 10th layer: (yellow filter layer) | | |
| Yellow colloidal silver | in terms of silver | 0.030 |
| Cpd-1 | | 0.16 |
| HBS-1 | | 0.60 |
| Gelatin | | 0.60 |
| 11th layer: (low sensitivity blue-sensitive emulsion layer) | | |
| AgBrI Emulsion C | in terms of silver | 0.18 |
| ExS-7 | | $8.6 \times 10^{-4}$ |
| ExY-1 | | 0.020 |

-continued (Sample 101)

| | | |
|---|---|---|
| ExY-2 | | 0.22 |
| ExY-3 | | 0.50 |
| ExY-4 | | 0.020 |
| HBS-1 | | 0.28 |
| Gelatin | | 1.10 |
| 12th layer: (middle sensitivity blue-sensitive emulsion layer) | | |
| AgBrI Emulsion D | in terms of silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |
| 13th layer: (high sensitivity blue-sensitive emulsion layer) | | |
| AgBrI Emulsion F | in terms of silver | 1.00 |
| ExS-7 | | $4.0 \times 10^{-4}$ |
| ExY-2 | | 0.10 |
| ExY-3 | | 0.10 |
| HBS-1 | | 0.070 |
| Gelatin | | 0.86 |
| 14th layer: (1st protective layer) | | |
| AgBrI Emulsion G | in terms of silver | 0.20 |
| UV-4 | | 0.11 |
| UV-5 | | 0.17 |
| HBS-1 | | $5.0 \times 10^{-2}$ |
| Gelatin | | 1.00 |
| 15th layer: (2nd protective layer) | | |
| H-1 | | 0.40 |
| B-1 (diameter: 1.7 μm) | | $5.0 \times 10^{-2}$ |
| B-2 (diameter: 1.7 μm) | | 0.10 |
| B-3 | | 0.10 |
| S-1 | | 0.20 |
| Gelatin | | 1.20 |

In order to improve the preservability, processability, pressure resistance, mildew resistance, bacteria resistance, antistatic properties, and coating properties of the material, W-1 to W-3, B-4 to B-6, F-1 to F-17, iron salt, lead salt, gold salt, platinum salt, iridium salt, and rhodium salt were incorporated in the various layers.

TABLE 1

| AgBrI Emulsion | Average AgI Content (%) | Average grain diameter (μm) | Grain diameter fluctuation coefficient (%) | Diameter/ thickness ratio | Silver amount ratio [Core/middle/shell] (AgI Content-mol %) | Grain structure/shape |
|---|---|---|---|---|---|---|
| A | 4.0 | 0.45 | 27 | 1 | [1/3] (13/1) | Double structure/ octahedron |
| B | 8.9 | 0.70 | 14 | 1 | [3/7] (25/2) | Doable structure/ octahedron |
| C | 2.0 | 0.55 | 25 | 7 | — | Uniform structure/ tablet |
| D | 9.0 | 0.65 | 25 | 6 | [12/59/29] (0/11/8) | Triple structure/ tablet |
| E | 9.0 | 0.85 | 23 | 5 | [8/59/33] (0/11/8) | Triple structure/ tablet |
| F | 14.5 | 1.25 | 25 | 3 | [37/63] (34/3) | Double structure/ tablet |
| G | 1.0 | 0.07 | 15 | 1 | — | Uniform Structure/ fine divided grain |

In Table 1, (1) AgBrI Emulsions A to F were subjected to reduction sensitization with thiourea dioxide and thiosulfonic acid in accordance with an Example in JP-A-2-191938;

(2) AgBrI Emulsions A to F were subjected to gold sensitization, sulfur sensitization and selenium sensitization in the presence of the spectral sensitizing dye as set forth with reference to the various light-sensitive layers and sodium thiocyanate in accordance with an Example in JP-A-3-237450;

(3) The preparation of tabular grains was carried out Using a low molecular gelatin in accordance with an Example in JP-A-1-158426; and (4) The grain structure of the tabular grains and regular crystal grains were observed under a high voltage electron microscope to exhibit a transition line as described in JP-A-3-237450.

ExC-1

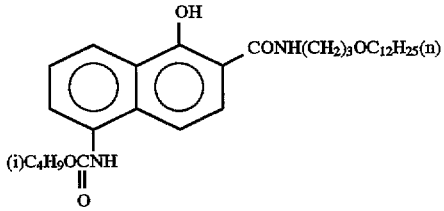

ExC-2

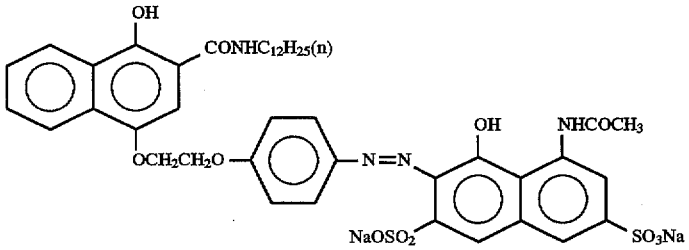

ExC-3

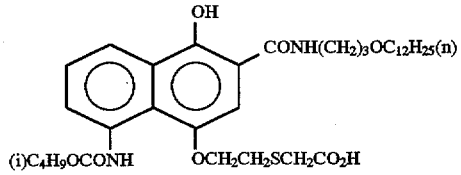

ExC-4

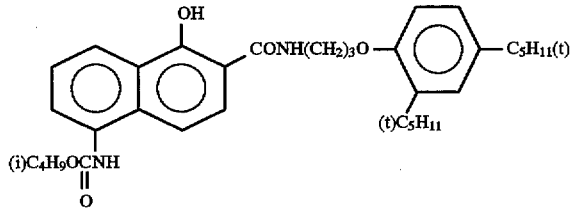

ExC-5

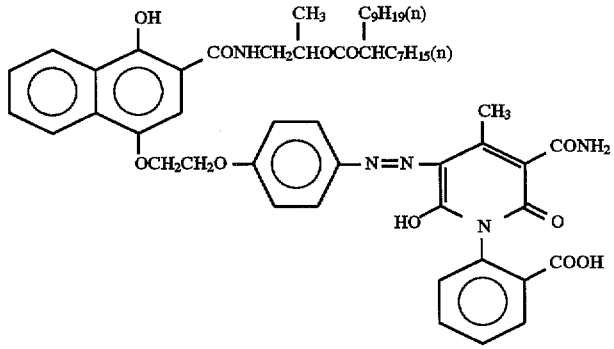

-continued
ExC-6
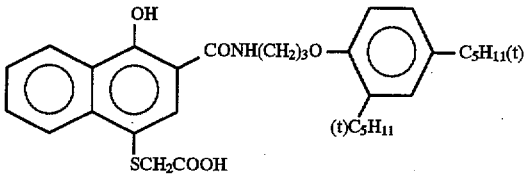
ExC-7
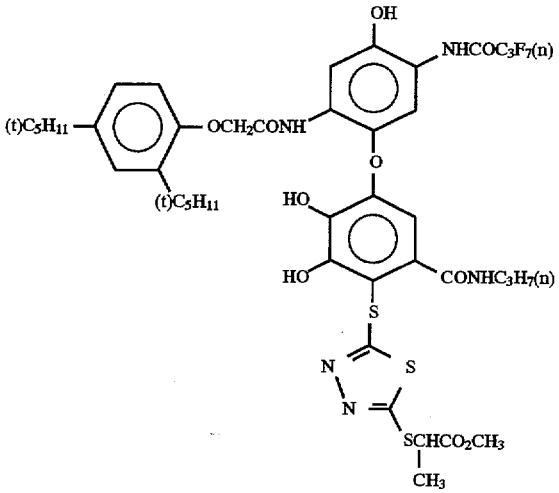
ExC-8
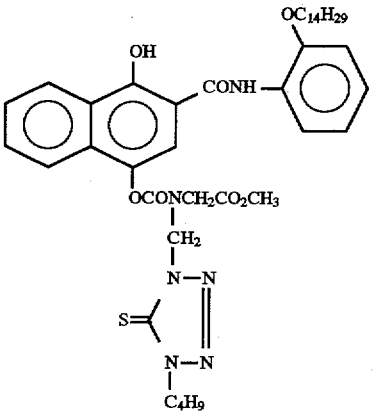
ExM-1
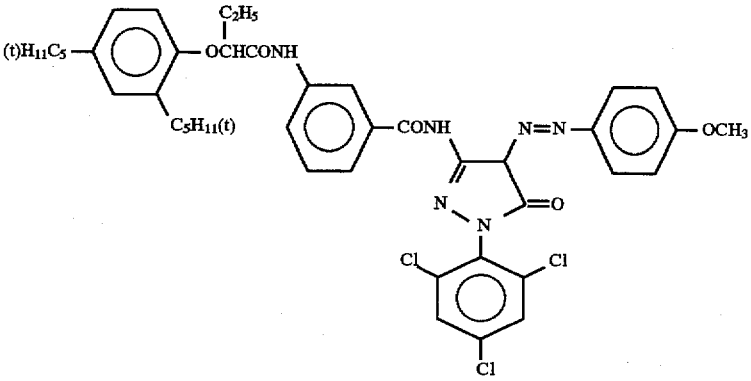

-continued
ExM-2
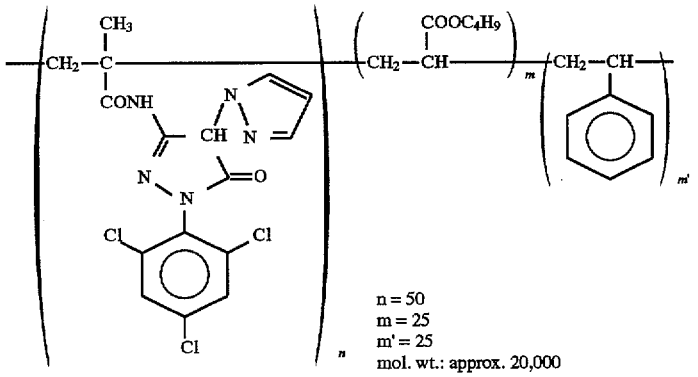
ExM-3
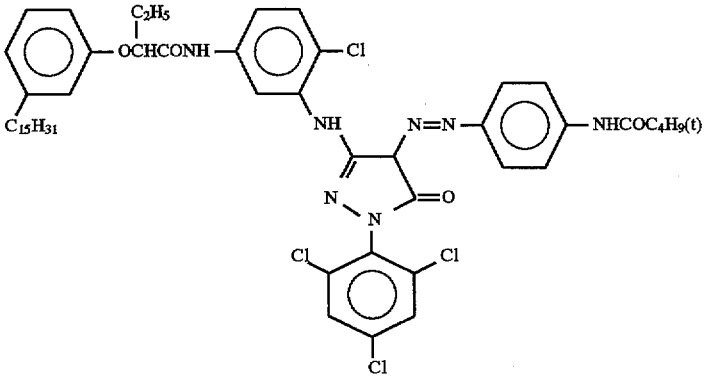
ExM-4
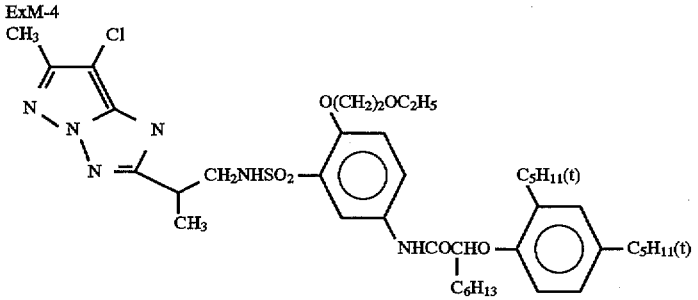
ExM-5
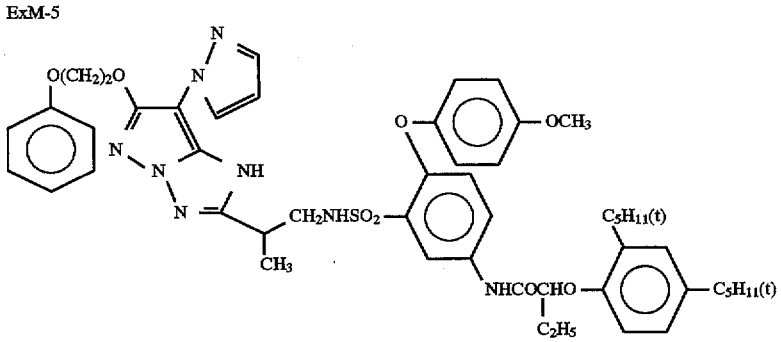

-continued
ExY-1
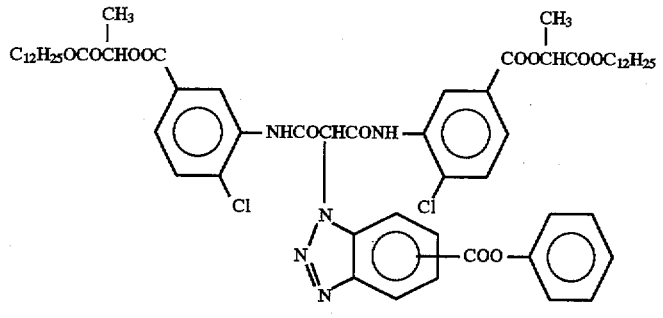
ExY-2
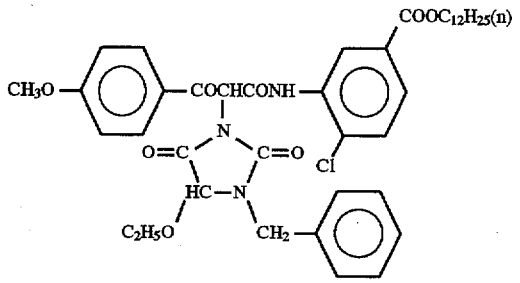
ExY-3
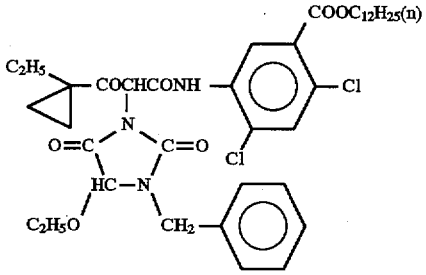
ExY-4
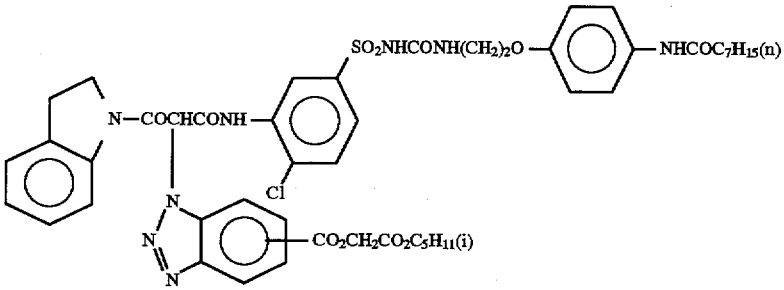
ExF-1
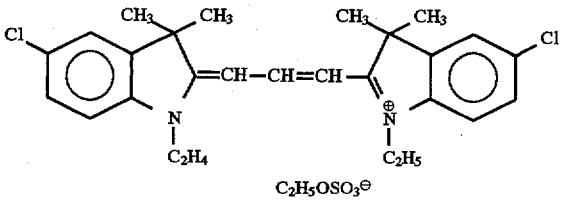

-continued
Cpd-1
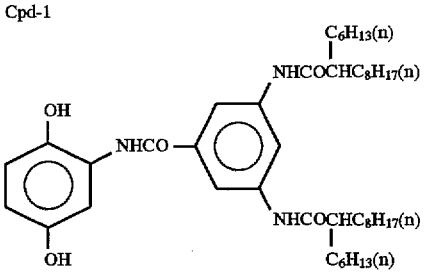
Cpd-2
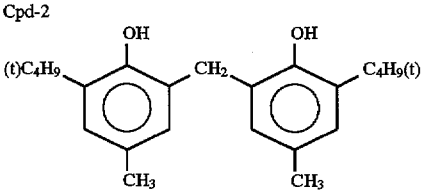
Cpd-3
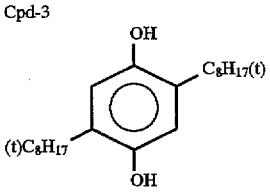
UV-1
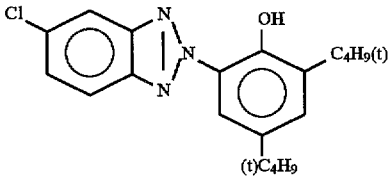
UV-2
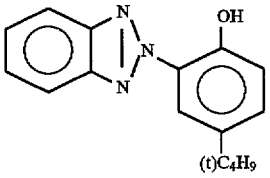
UV-3
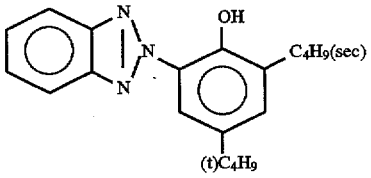
UV-4
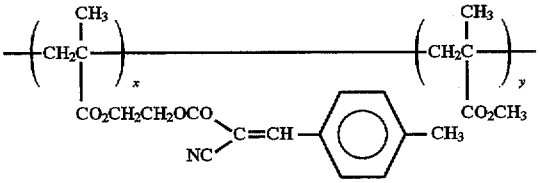
x:y = 70:30 (wt %)

-continued
UV-5
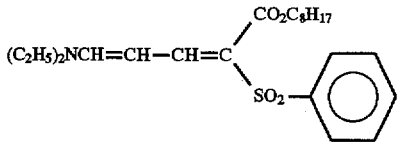
HBS-1:
Tricresyl phosphate
HBS-2:
Di-n-butyl phthalate
HBS-3:
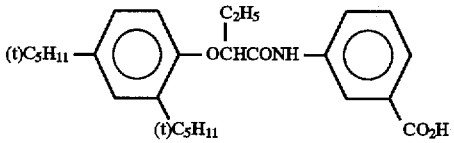
ExS-1
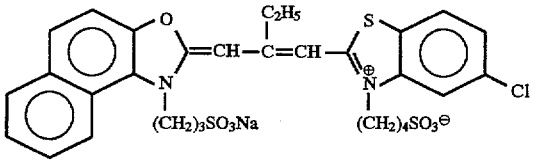
ExS-2
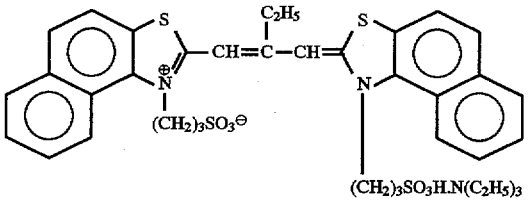
ExS-3
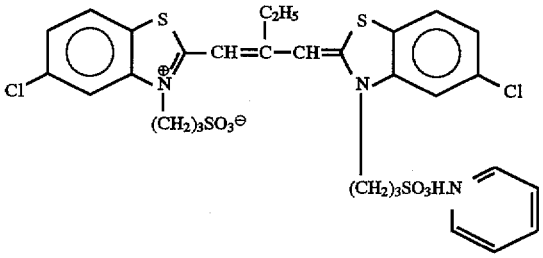
ExS-4
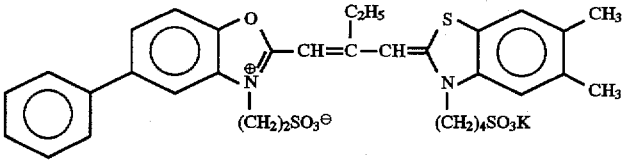
ExS-5
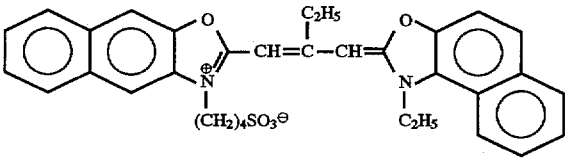

-continued
ExS-6
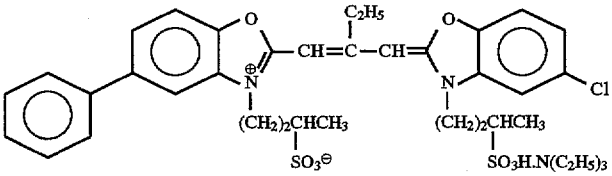
ExS-7
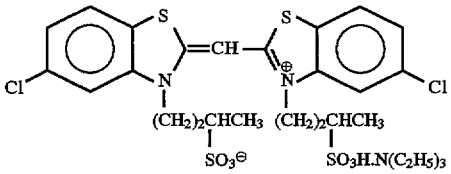
S-1
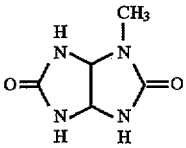
H-1
$CH_2{=}CH{-}SO_2{-}CH_2{-}CONH{-}CH_2$
$CH_2{=}CH{-}SO_2{-}CH_2{-}CONH{-}CH_2$
B-1
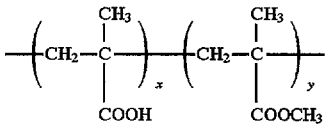
x/y = 10/90
B-2
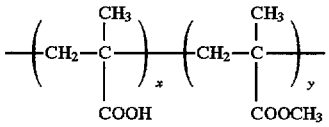
x/y = 40/60
B-3
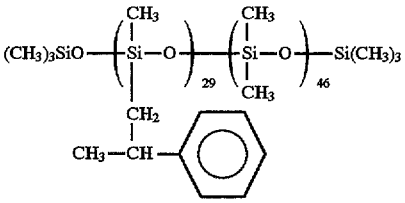
B-4
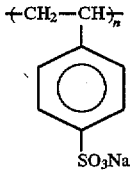
B-5
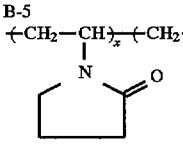
x/y = 70/30

-continued
B-6
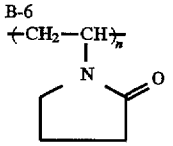
(mol. wt.: approx. 10,000)
W-1
$C_8F_{17}SO_2NHCH_2CH_2CH_2OCH_2CH_2\overset{\oplus}{N}(CH_3)_3$
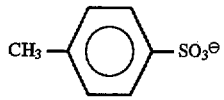
W-2
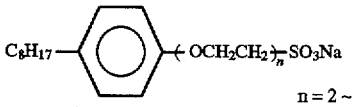
n = 2 ~ 4
W-3
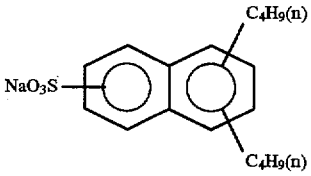
F-1
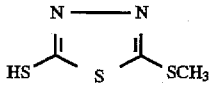
F-2
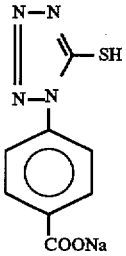
F-3
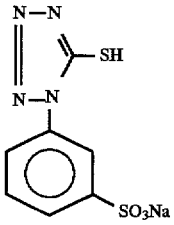
F-4
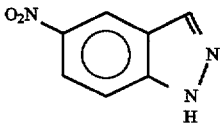
F-5
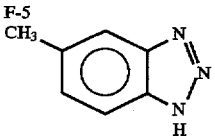

-continued
F-6
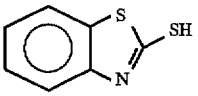
F-7
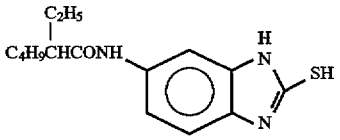
F-8
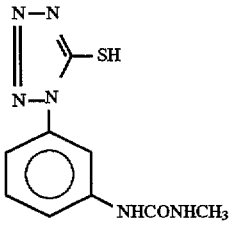
F-9
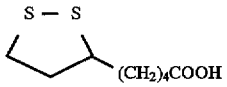
F-10
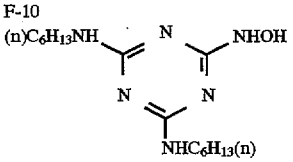
F-11
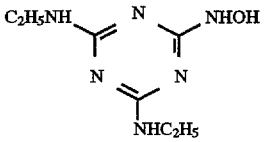
F-12
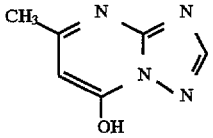
F-13
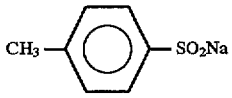
F-14
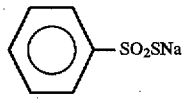
F-15
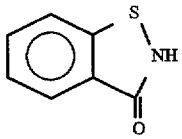

-continued

F-16

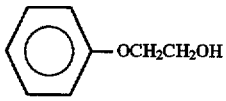

F-17

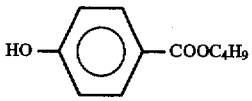

The color photographic material samples thus prepared were imagewise exposed through a step wedge and then processed using an automatic developing machine until the accumulated replenishment amount of the developer reached three times the tank capacity.

(Processing method)

| Step | Processing time | Processing temperature | Replenishment rate* | Tank Capacity |
|---|---|---|---|---|
| Color development | 3 min. 15 sec. | 38° C. | 22 ml | 20 l |
| Bleach | 2 min. 30 sec. | 38° C. | 25 ml | 40 l |
| Rinse | 30 sec. | 24° C. | 1,200 ml | 20 l |
| Fixing | 5 min. 00 sec. | 38° C. | 25 ml | 30 l |
| Rinse (1) | 30 sec. | 24° C. | ** | 10 l |
| Rinse (2) | 30 sec. | 24° C. | 1,200 ml | 10 l |
| Stabilization | 30 sec. | 38° C. | 25 ml | 10 l |
| Drying | 4 min. 20 sec. | 55° C. | | |

*Replenishment rate: per 1-m long 35-mm wide specimen
**Countercurrent process in which the washing water is introduced into Rinse (2) and overflows into Rinse (1).

The various processing solutions had the following compositions:

| | Running Solution (g) | Replenisher (g) |
|---|---|---|
| Color developer | | |
| Diethylenetriamine-pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.3 |
| Potassium iodide | 1.5 mg | — |
| Hydroxylamine sulfate | 2.4 | 2.8 |
| 4-[N-ethyl-N-β-hydroxyethylamino]-2-methylaniline sulfate | 4.5 | 6.2 |
| Water to make | 1.0 l | 1.0 l |
| pH | 10.05 | 10.15 |
| Bleaching solution | | |
| Ferric complex salt (III) of compound set forth in Table 2 | 260 mmol | 315 mmol |
| 3-Mercapto-1,2,4-triazole | 0.08 | 0.09 |
| Sodium bromide | 147.0 | 168.0 |
| Sodium nitrate | 32.0 | 37.3 |
| Water to make | 1.0 l | 1.0 l |
| pH (adjusted with NaOH, $HNO_3$) | 6.0 | 5.7 |
| Fixing solution | | |
| Sodium sulfite | 20.0 | 22.0 |

-continued

| | Running Solution (g) | Replenisher (g) |
|---|---|---|
| Aqueous solution of ammonium thiosulfate (700 g/l) | 290.0 ml | 320.0 ml |
| Water to make | 1.0 l | 1.0 l |
| pH | 6.0 | 5.7 |
| Stabilizing solution Common to both running solution and replenisher | | |
| Sodium p-toluenesulfinate | | 0.03 |
| Polyoxyethylene-p-monononylphenyl ether (average polymerization degree: 10) | | 0.2 |
| Disodium ethylenediaminetetraacetate | | 0.05 |
| 1,2,4-Triazole | | 1.3 |
| 1,4-Bis(1,2,4-triazole-1-ilmethyl) piperazine | | 0.75 |
| Water to make | | 1.0 l |
| pH | | 8.5 |

The photographic material specimens thus processed were evaluated with respect to amount of residual silver, bleach fog, and stain increase with time by the following methods:

Amount of residual silver:

The amount of silver remaining on the Dmax portion of the photographic material by measured by a X-ray fluorescence analysis technique.

Bleach fog:

The density of the photographic material samples thus processed were measured for density as a function of exposure (sensitometry). From the characteristic curve, Dmin measured with green light was read.

Another batch of the same photographic material sample was processed in the same manner as described above except that the bleaching solution was replaced by the reference bleaching solution having the formulation set forth below, and the bleaching time was changed to 6 minutes and 30 seconds. The sample was then measured for Dmin (as the reference Dmin) in the same manner as described above.

The bleach fog of the magenta dye image is defined by the following equation:

$$\text{Bleach fog} = Dmin - \text{reference } Dmin$$

(Reference bleaching solution)

| | |
|---|---|
| Water | 700 ml |
| Ethylenediaminetetraacetic acid | 0.28 mol |
| Ferric nitrate (III) nonahydrate | 0.25 mol |
| Ammonium bromide | 1.4 mol |
| Ammonium nitrate | 0.2 mol |
| Water to make | 1,000 ml |

-continued

| (Reference bleaching solution) | |
|---|---|
| pH (adjusted with aqueous ammonia, nitric acid) | 6.0 |

Stain change with time:

The photographic material samples processed as described above was measured for density as a function of exposure (sensitometry). From the characteristic curve, Dmin measured with green light was read. The sample thus measured was then stored under the following conditions. Dmin after ageing was similarly measured. The stain change of the magenta dye image with time was determined in accordance with the following equation:

Storage conditions: 60° C., 70%, 4 weeks

Stain change with time (ΔD) =(Dmin after storage)−(Dmin before storage)

The results are set forth in Table 2.

TABLE 2

| Compound | Amount of residual silver | Bleach fog | ΔD | Remarks |
|---|---|---|---|---|
| EDTA | 7.8 μg/cm$^2$ | 0.00 | 0.02 | Comparative |
| 1,3-PDTA | 1.8 | 0.18 | 0.10 | " |
| I-1* | 3.2 | 0.00 | 0.01 | Present Invention |
| I-2* | 1.7 | 0.05 | 0.05 | " |
| I-11* | 2.8 | 0.02 | 0.03 | " |

*I-1, I-2 and I-11 each is a mixture of optical isomers [R,R], [S,S] and [S,R].

Table 2 shows that as compared with the comparative compounds, bleaching with the ferric complex salts of the compounds of formula (I) of the present invention results in a substantial reduction in the amount of residual silver, while providing excellent bleach fog and stain inhibiting effects upon storage of the color image after processing.

EXAMPLE 2

A photographic material sample was prepared and exposed to light in the same manner as in Example 1, and then subjected to processing in the manner as described below by means of an automatic developing machine until the accumulated replenishment rate of the developer reached three times the tank capacity.

(Processing method)

| Step | Processing time | Processing temperature | Replenishment rate* | Tank Capacity |
|---|---|---|---|---|
| Color development | 3 min. 15 sec. | 38° C. | 45 ml | 10 l |
| Bleach | 40 sec. | 38° C. | 20 ml | 4 l |
| Blix | 2 min. 00 sec. | 38° C. | 30 ml | 8 l |
| Rinse (1) | 40 sec. | 35° C. | ** | 4 l |
| Rinse (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

*Replenishment rate; per 1-m long 35-mm wide specimen

**Countercurrent process in which the washing water is introduced into Rise (2) and overflows into Rinse (1).

The various processing solutions had the following compositions:

| | Running Solution (g) | Replenisher (g) |
|---|---|---|
| Color developer | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxyethylamino]-2-methylaniline sulfate | 4.5 | 5.5 |
| Water to make | 1.0 l | 1.0 l |
| pH | 10.05 | 10.10 |
| Bleaching solution Common to both running solution and replenisher | | |
| Ferric complex salt (III) of the compound set forth in Table 3 | | 0.30 mol |
| Compound set forth in Table 3 | | 27 mmol |
| Potassium bromide | | 100.0 |
| Potassium nitrate | | 10.0 |
| Bleach accelerator $(CH_3)_2N—CH_2—CH_2—S—S—CH_2—CH_2—N(CH_3)_2.2HCl$ | | 0.005 mol |
| Water to make | | 1.0 l |
| pH (adjusted with KOH) | | 6.3 |
| Blix solution | | |
| Ferric complex salt (III) of compound set forth in Table 3 | 0.125 mol | — |
| Compound set forth in Table 3 | 13 mmol | 5 mmol |
| Sodium sulfite | 12.0 | 20.0 |
| Aqueous solution of ammonium thiosulfate (700 g/l) | 240.0 ml | 400.0 ml |
| 27 wt % Aqueous ammonia | 6.0 ml | — |
| Water to make | 1.0 l | 1.0 l |
| pH | 7.2 | 7.3 |

Rinsing solution (common to both running solution and replenisher)

Tap water was passed through a mixed bed column filled with an H-type strongly acidic cation exchange resin (Amberlite IR-120B produced by Rohm & Haas) and an OH-type anion exchange resin (Amberlite IR-400) so that the calcium and magnesium ion concentrations were each reduced to 3 mg/l or less. To the solution were then added 20 mg/l of dichlorinated sodium isocyanurate and 150 mg/l of sodium sulfate. The pH range of the solution was from 6.5 to 7.5.

| Stabilizing solution (common to both running solution and replenisher | |
|---|---|
| Sodium p-toluenesulfonate | 0.03 |
| Polyoxyethylene-p-monononylphenylether (average polymerization degree: 7) | 0.2 |
| Disodium ethylenediaminetetraacetate | 0.05 |
| 1,2,4-Triazole | 1.3 |
| 1,4-Bis(1,2,4-triazole-1-ilmethyl) piperazine | 0.75 |
| Water to make | 1.0 l |
| pH | 8.5 |

The photographic material sample which had been thus processed was evaluated with respect to residual silver, bleach fog and stain change with time in the same manner as in Example 1. The results are set forth in Table 3.

TABLE 3

| Compound | Amount of residual silver | Bleach fog | ΔD | Remarks |
|---|---|---|---|---|
| EDTA | 8.3 μg/cm² | 0.00 | 0.03 | Comparative |
| 1,3-PDTA | 2.2 | 0.25 | 0.11 | " |
| I-1* | 2.7 | 0.00 | 0.01 | Present Invention |
| I-2* | 1.9 | 0.08 | 0.04 | " |
| I-11* | 3.6 | 0.02 | 0.02 | " |

*I-1, I-2 and I-11 each is a mixture of optical isomers [R,R], [S,S] and [S,R].

Table 3 shows that as compared with the comparative compounds, bleaching with the ferric complex salts of the compound of formula (I) of the present invention reduces the amount of residual silver, while providing excellent bleach fog and stain inhibiting effects upon storage of the color image after processing as in Example 1.

EXAMPLE 3

A photographic material sample was prepared in the same manner as in Example 1. The sample was cut into 35-mm wide strips. The sample was then exposed by picture taking with a camera. The sample was then processed at a rate of 1 m² a day for 15 days in the following manner.

The processing was conducted by means of a Type FP-560B automatic developing machine available from Fuji Photo Film Co., Ltd.

The processing steps and processing compositions are given below.

(Processing method)

| Step | Processing time | Processing temperature | Replenishment rate* | Tank Capacity |
|---|---|---|---|---|
| Color development | 3 min. 05 sec. | 38° C. | 600 ml | 17 l |
| Bleach | 30 sec. | 38° C. | 140 ml | 5 l |
| Blix | 30 sec. | 38° C. | — | 5 l |
| Fixing | 60 sec. | 38° C. | 420 ml | 5 l |
| Rinse | 30 sec. | 38° C. | 980 ml | 3.5 l |
| Stabilization (1) | 20 sec. | 38° C. | — | 3 l |
| Stabilization (2) | 20 sec. | 38° C. | 560 ml | 3 l |
| Drying | 1 min. 30 sec. | 60° C. | | |

*Replenishment rate: per 1 m²

The stabilization step was effected in a counter-flow system wherein the solution is introduced into tank (2) and overflaws into tank (1). All of the overflow from the rinse bath was introduced into the fixing bath. For replenishment of the blix bath, a notch was provided on the upper portion of the bleach bath and the fixing bath in the automatic developing machine, so that all the overflow solution by replenishment of the bleach bath and the fixing bath was introduced into the blix bath. The amount of the developer brought over to the bleach step, the amount of the bleaching solution brought over to the blix step, the amount of the blix solution brought over to the fix step, and the amount of the blix solution brought over to the rinse step were 65 ml, 50 ml, 50 ml and 50 ml per m² of a 35-mm wide light-sensitive material, respectively. The crossover time was 6 seconds at each step. This crossover time was included in the pre-processing time.

The composition of the various processing solutions is given below.

| | Running Solution (g) | Replenisher (g) |
|---|---|---|
| Color developer | | |
| Diethylenetriaminepentaacetic acid | 2.0 | 2.0 |
| 1-Hydroxyethylidene-1,1-diphosphonic acid | 3.3 | 3.3 |
| Sodium sulfite | 3.9 | 3.3 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]aniline sulfate | 4.5 | 6.0 |
| Water to make | 1.0 l | 1.0 l |
| pH | 10.05 | 10.15 |
| Bleaching solution | | |
| Compound set forth in Table 4 | 0.33 mol | 0.49 mol |
| Ferric nitrate (III) nonahydrate | 0.33 mol | 0.49 mol |
| Ammonium bromide | 70 | 105 |
| Hydroxyacetic acid | 50 | 75 |
| Acetic acid | 10 | 15 |
| Water to make | 1.0 l | 1.0 l |
| pH (adjusted with aqueous amonia) | 4.4 | 4.4 |

Blix solution (running solution)

15:85 (volume ratio) mixture of the above described bleaching solution (running solution) and the following fixing solution (running solution) (pH 7.0).

Fixing solution

| | Running Solution (g) | Replenisher (g) |
|---|---|---|
| Ammonium sulfite | 19 | 57 |
| Aqueous solution of ammonium thiosulfate (700 g/l) | 280 ml | 840 ml |
| Imidazole | 15 | 45 |
| Ethylenediaminetetraacetic acid | 15 | 45 |
| Water to make | 1.0 l | 1.0 l |
| pH (adjusted with aqueous ammonia and acetic acid) | 7.4 | 7.45 |

Rinsing solution

The rinsing solution described in Example 2 was used.

Stabilizing solution

The stabilizing solution described in Example 2 was used.

The photographic material sample thus processed was evaluated with respect to residual silver, bleach fog and stain change with time in the same manner as in Example 1. The results are set forth in Table 4.

TABLE 4

| Compound | Amount of residual silver | Bleach fog | ΔD | Remarks |
|---|---|---|---|---|
| 1,3-PDTA | 1.2 | 0.10 | 0.08 | Comparative |
| I-2* | 1.3 | 0.03 | 0.02 | Present Invention |
| I-3* | 1.2 | 0.05 | 0.03 | " |

*I-2 and I-3 each is a mixture of optical isomers [R,R], [S,S] and [S,R].

Table 4 shows that as compared with the comparative compounds, the metallic chelate compounds of the present invention reduce the amount of residual silver and provide excellent bleach fog and stain inhibiting effects upon storage of the color image after processing as in Example 1.

EXAMPLE 4

The surface of a polyethylene double-laminated paper support was subjected to corona discharge. On the paper support was provided a gelatin undercoating layer containing sodium dodecylbenzenesulfonate. On the undercoating layer were coated various photographic constituent layers to prepare a multilayer color photographic paper having the following layer construction (Specimen 001). The coating solutions were prepared as follows:

Preparation of 1st layer coating solution 158.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 25 g of a solvent (Solv-1), 25 g of a solvent (Solv-2) and 180 cc of ethyl acetate to make a solution. The solution thus obtained was then emulsion-dispersed in 1,000 g of a 10 wt. % aqueous solution of gelatin containing 60 cc of sodium dodecylbenzenesulfonate and 10 g of citric acid. On the other hand, a silver bromochloride emulsion A (3:7 (Ag molar ratio) mixture of a large size emulsion A of cubic grains having an average size of 0.88 μm with a grain size distribution fluctuation coefficient of 0.08 and a small size emulsion A of cubic grains having an average size of 0.70 μm with a grain size distribution fluctuation coefficient of 0.10, 0.3 mol % of silver bromide being localized partially on the surface of each emulsion) was prepared. This emulsion comprised blue-sensitive sensitizing dyes A and B having the chemical structure set forth below in an amount of $2.0\times10^{-4}$ mol per mol of Ag each for the large size emulsion and $2.5\times10^{-4}$ mol per mol of Ag each for the small size emulsion. The chemical ripening of this emulsion was carried out by the addition of a sulfur sensitizer and a gold sensitizer. The previously prepared emulsion dispersion A and the silver bromochloride emulsion A were mixed to prepare a coating solution for the 1st layer having the formulations set forth below. The coated amount of emulsion is represented in terms of silver content.

The coating solutions for the 2nd layer to the 7th layer were prepared in the same manner as the coating solution for the 1st layer. The gelatin hardener used for each layer there was the sodium salt of 1-oxy-3,5-dichloro-s-triazine.

To these layers were each added Cpd-14 and Cpd-15 in a total amount of 25.0 mg/m$^2$ and 50.0 mg/m$^2$, respectively.

To the silver bromochloride emulsion in these light-sensitive emulsion layers were added the following spectral sensitizing dyes.

Blue-sensitive emulsion layer

Sensitizing dye A

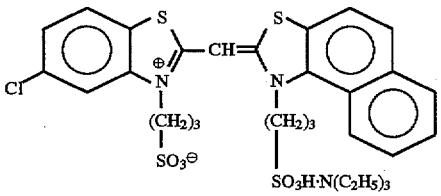

Sensitizing dye B

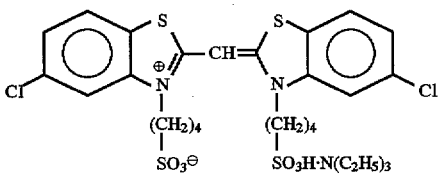

($2.0\times10^{-4}$ mol each for the large size emulsion and $2.5\times10^{-4}$ mol each for the small size emulsion per mol of silver halide)

Green-sensitive emulsion layer

Sensitizing dye C

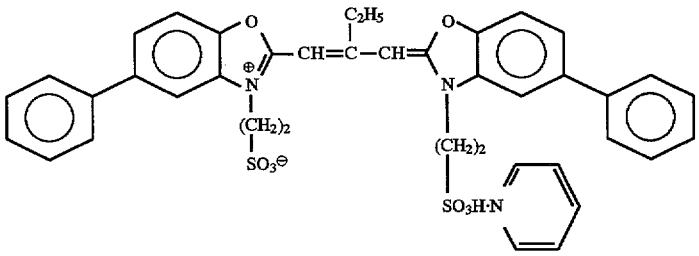

($4.0\times10^{-4}$ mol each for the large size emulsion and $5.6\times10^{-4}$ mol each for the small size emulsion per mol of silver halide)

-continued

Sensitizing dye D

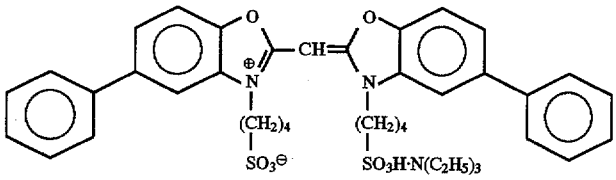

($7.0 \times 10^{-5}$ mol each for the large size emulsion and
$1.0 \times 10^{-4}$ mol each for the small size emulsion per mol of silver halide)

Red-sensitive emulsion layer

Sensitizing dye E

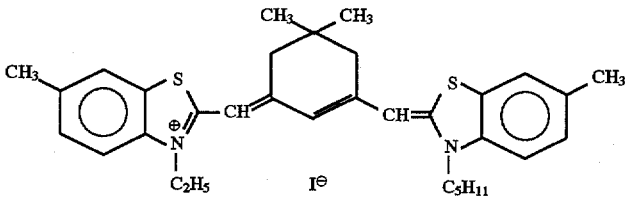

($0.9 \times 10^{-4}$ mol each for large size emulsion and
$1.1 \times 10^{-4}$ mol each for small size emulsion per mol of silver halide)

Furthermore, a compound having the chemical structure F set forth below was incorporated in the red-sensitive emulsion layer in an amount of $2.6\times10^{-3}$ mol per mol of silver halide.

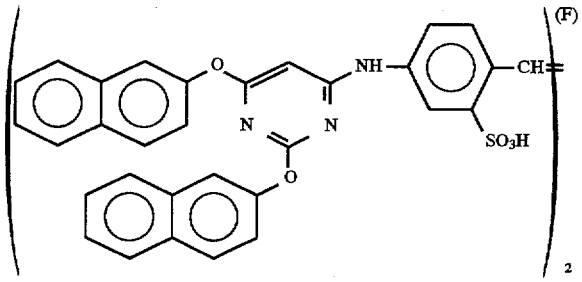

To each of the blue-sensitive emulsion layer, the green-sensitive emulsion layer and the red-sensitive emulsion layer were added 1-(5-methylureidephenyl)-5-mercaptotetrazole in an amount of $8.5\times10^{-5}$ mol, $7.7\times10^{-4}$ mol and $2.5\times10^{-4}$ mol per mol of silver halide, respectively. To each of the blue-sensitive emulsion layer and the green-sensitive emulsion layer were added 4-hydroxy-6-methyl-1,3,3a,7-tetrazaindene in an amount of $1.0\times10^{-4}$ mol and $2.0\times10^{-4}$ mol per mol of silver halide, respectively.

For inhibiting irradiation, the following dyes were added to each of the emulsion layers (figures in the parenthesis indicate the coated amount):

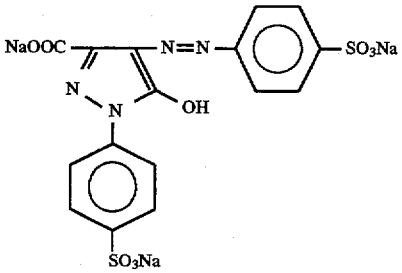

(10 mg/m²)

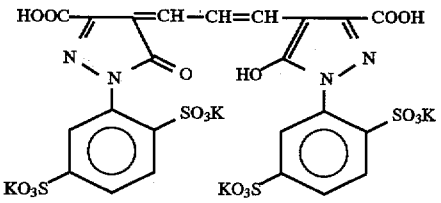

(10 mg/m²)

-continued

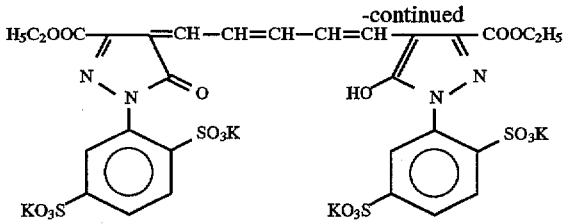

(40 mg/m²)

and

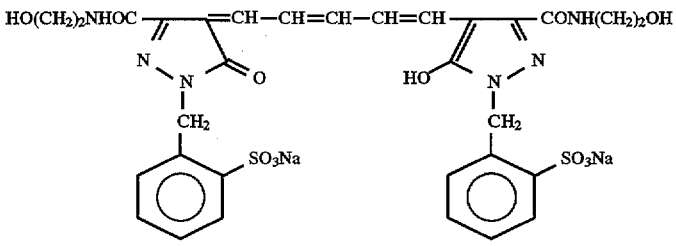

(20 mg/m²)

(Layer construction)

The formulations of the various layers are set forth below. The figures indicate the coated amount (g/m²). The coated amount of the silver halide emulsions is represented in terms of silver content.

Support

Polyethylene-laminated paper (containing a white pigment ($TiO_2$) and a bluish dye (ultramarine) in polyethylene on the 1st layer side)

| | |
|---|---|
| 1st layer (blue-sensitive emulsion layer) | |
| Silver bromochloride emulsion A as described above | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| 2nd layer (color stain inhibiting layer) | |
| Gelatin | 1.00 |
| Color stain inhibitor (Cpd-4) | 0.06 |
| Solvent (Solv-7) | 0.03 |
| Solvent (Solv-2) | 0.25 |
| Solvent (Solv-3) | 0.25 |
| 3rd layer (green-sensitive emulsion layer) | |
| Silver bromochloride emulsion (1:3 (Ag molar ratio) mixture of a large size emulsion of cubic grains having an average size of 0.55 μm with a grain size distribution fluctuation coefficient of 0.10 and a small size emulsion of cubic grains having an average size of 0.39 μm with a grain size distribution fluctuation coefficient of 0.08, 0.8 mol % of silver bromide being localized partially on the surface of each emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |

-continued

| | |
|---|---|
| Solvent (Solv-4) | 0.15 |
| Solvent (Solv-5) | 0.15 |
| 4th layer (color stain inhibiting layer) | |
| Gelatin | 0.70 |
| Color stain inhibitor (Cpd-4) | 0.04 |
| Solvent (Solv-7) | 0.02 |
| Solvent (Solv-2) | 0.18 |
| Solvent (Solv-3) | 0.18 |
| 5th layer (red-sensitive emulsion layer) | |
| Silver bromochloride emulsion (1:3 (Ag molar ratio) mixture of a large size emulsion of cubic grains having an average size of 0.50 μm with a grain size distribution fluctuation coefficient of 0.09 and a small size emulsion of cubic grains having an average size of 0.41 μm with a grain size distribution fluctuation coefficient of 0.11, 0.8 mol % of silver bromide being localized partially on the surface of each emulsion) | 0.20 |
| Gelatin | 0.85 |
| Cyan coupler (ExC) | 0.33 |
| Ultraviolet absorbent (UV-2) | 0.18 |
| Dye image stabilizer (Cpd-1) | 0.30 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| 6th layer (ultraviolet absorbing layer) | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| 7th layer (protective layer) | |
| Gelatin | 1.13 |
| Acryl-modified copolymer of polyvinyl alcohol (modification degree: 17%) | 0.05 |
| Liquid paraffin | 0.02 |

Yellow coupler (ExY)
1:1 (molar ratio) mixture of
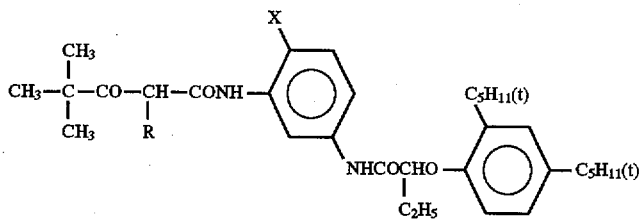
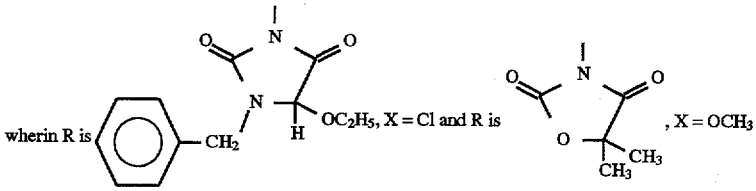
Magenta coupler (ExM)
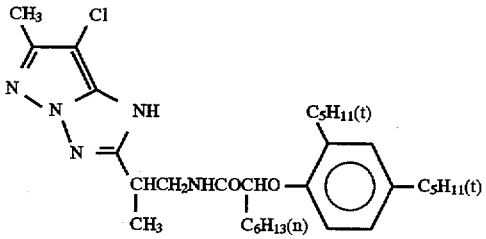
Cyan coupler (ExC)
3:7 (molar ratio) of:
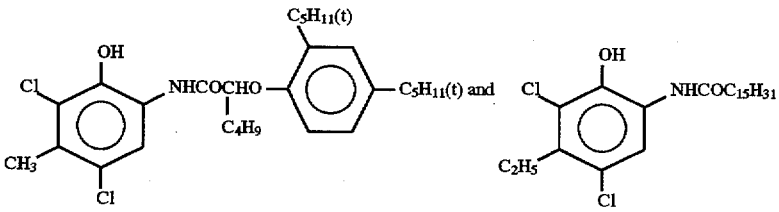
Dye stabilizer (Cpd-1)
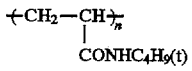
(average molecular weight: 60,000)
Dye stabilizer (Cpd-2)
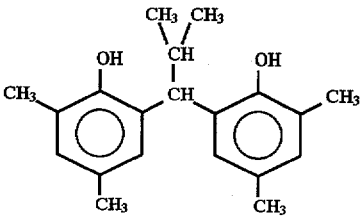

-continued
Dye image stabilizer (Cpd-3)
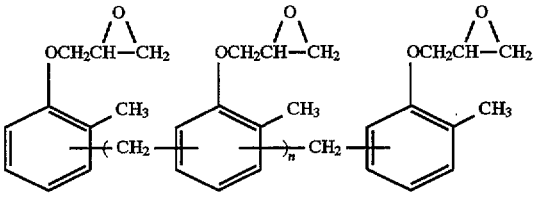
n = 7 to 8 (average)
Color stain inhibitor (Cpd-4)
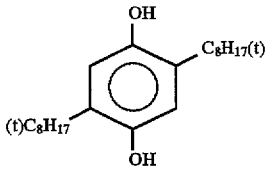
Dye image stabilizer (Cpd-5)
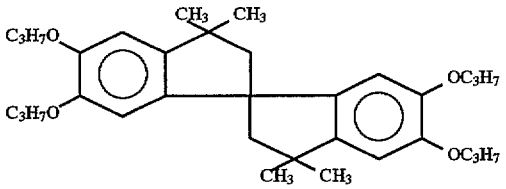
Dye image stabilizer (Cpd-6)
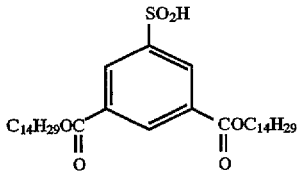
Dye image stabilizer (Cpd-7)
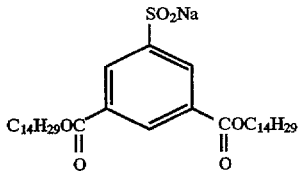
Dye image stabilizer (Cpd-8)
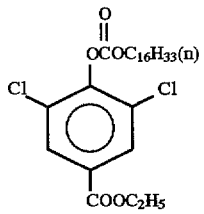

-continued
Dye image stabilizer (Cpd-9)
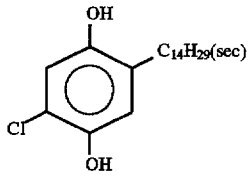
Dye image stabilizer (Cpd-10)
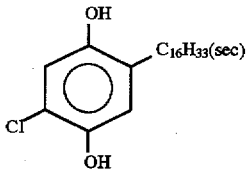
Dye image stabilizer (Cpd-11)
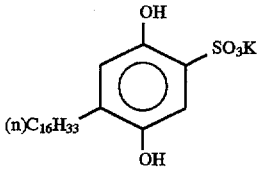
Dye image stabilizer (Cpd-12)
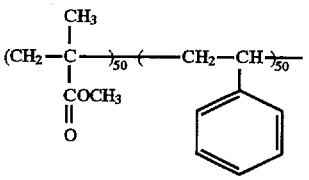
average molecular weight: 60,000
Dye image stabilizer (Cpd-13)
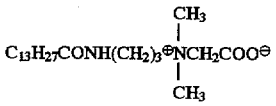
Preservative (Cpd-14)
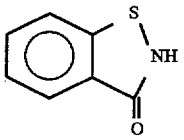
Preservative (Cpd-15)
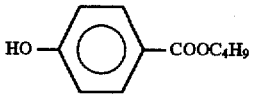
Solvent (Solv-1)
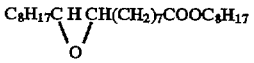

-continued
Solvent (Solv-2)
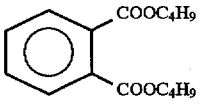
Solvent (Solv-3)
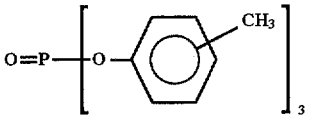
Solvent (Solv-4)
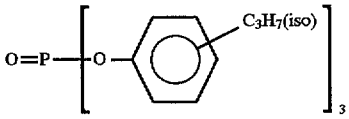
Solvent (Solv-5)
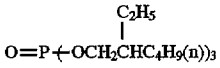
Solvent (Solv-6)
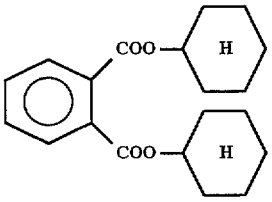
Solvent (Solv-7)
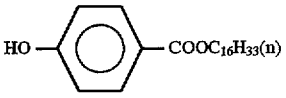
Untraviolet absorbent (UV-1)
1:5:10:5 (weight ratio) mixture of:
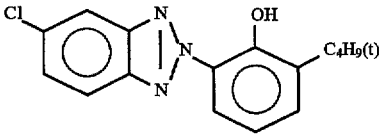
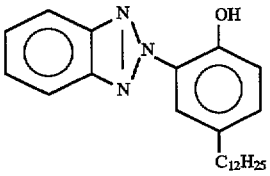
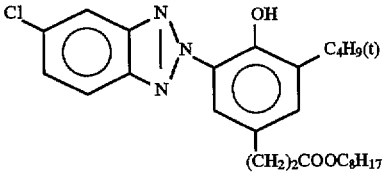

-continued

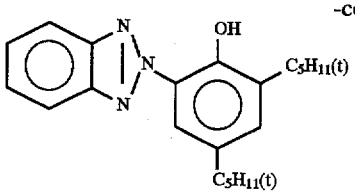

Ultraviolet absorbent (UV-2)

1:2:2 (weight ratio) mixture of:

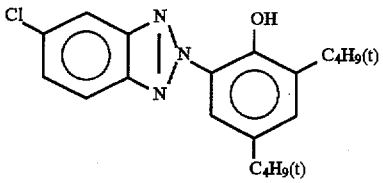

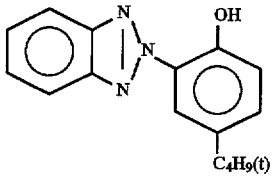

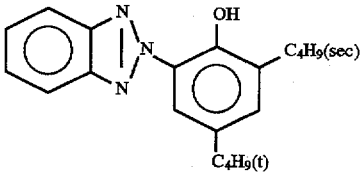

The above described photographic light-sensitive material specimen was imagewise exposed to light using a paper processing machine, and then subjected to continuous processing (running test) with the following processing solutions using the following processing steps until the color developer was replenished by an amount twice its tank capacity.

| Processing step | Temperature | Time | Replenisher* | Tank capacity |
|---|---|---|---|---|
| Color development | 38.5° C. | 45 sec. | 73 ml | 20 l |
| Blix | 35° C. | 30 sec. | 60 ml** | 20 l |
| Rinse 1 | 35° C. | 20 sec. | — | 10 l |
| Rinse 2 | 35° C. | 20 sec. | — | 10 l |
| Rinse 3 | 35° C. | 20 sec. | 360 ml | 10 l |
| Drying | 80° C. | 40 sec. | | |

*per $m^2$ of light-sensitive material

**In addition to 60 ml of replenisher, 120 ml was supplied from Rinse 1 per $m^2$ of light-sensitive material processed.

(The rinse step was effected in a counter-flow process where the washing water overflow was introduced into the preceding rinse tank.)

The formulations of the various processing solutions were as follows:

| | Running Solution | Replenisher |
|---|---|---|
| Color developer | | |
| Water | 800 ml | 800 ml |
| Ethylenediaminetetraacetic acid | 3.0 g | 3.0 g |
| Disodium 4,5-dihydroxy-benzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (Whitex 4 produced by Sumitomo Chemical Co., Ltd.) | 1.0 g | 3.0 g |
| Sodium sulfite | 0.1 g | 0.1 g |
| Disodium-N,N-bis(sulfonate-ethyl) hydroxylamine | 5.0 g | 10.0 g |
| Sodium triisopropyl-naphthalene(β) sulfonate | 0.1 g | 0.1 g |
| N-ethyl-N-(β-methanesulfon-amideethyl-3-methyl-4-amino-anilinesulfate | 5.0 g | 11.5 g |
| Water to make | 1,000 ml | 1,000 ml |
| pH (25° C./adjusted with potassium hydroxide and sulfuric acid) | 10.00 | 11.00 |
| Blix solution | | |
| Water | 600 ml | 150 ml |
| Ammonium thiosulfate (700 g/l) | 100 ml | 250 ml |
| Ammonium sulfite | 40 g | 100 g |
| Ferric complex salt (III) of the compound set forth in | 0.10 mol | 0.30 mol |

-continued

| | Running Solution | Replenisher |
|---|---|---|
| Table 5 | | |
| Ammonium bromide | 40 g | 75 g |
| Nitric acid (67 wt %) | 30 g | 65 g |
| Water to make | 1 l | 1 l |
| pH (25° C./adjusted with acetic acid and aqueous ammonia) | 5.8 | 5.6 |
| Washing solution (running solution was also used as the replenisher) | | |
| Sodium chloroisocyanurate | | 0.02 g |
| Deionized water (electric conductivity: 5 μs/cm or less) | | 1 l |
| pH | | 6.5 |

The photographic material sample thus processed was then measured for the minimum yellow density on the unexposed portion using the Macbeth density system for the evaluation of bleach fog. The sample was also measured for the amount of residual silver in the maximum density portion (10 CMS) by X-ray fluorescence for evaluation of desilvering properties. The results are set forth in Table 5.

TABLE 5

| Compound | Amount of residual silver | Yellow density | Remarks |
|---|---|---|---|
| EDTA | 0.15 μg/cm$^2$ | 0.18 | Comparative |
| I-1* | 0.05 | 0.07 | Present Invention |
| I-11* | 0.03 | 0.06 | " |

*I-1 and I-11 each is optical isomer [S,S].

Table 5 shows that the processing composition of the present invention exhibits excellent desilvering properties, as well as remarkably reduced bleach fog as compared with the comparative processing solution containing the metal complex of EDTA instead of the metal complex of the compound of formula (I).

EXAMPLE 5

Ferric complex salts (III) of EDTA and ferric complex salts (III) of [S,S] form of the exemplary compound (I-1) of the present invention were evaluated for biodegradability in accordance with the 302B Amendment of the Zahn-Wellens test given in the OECD Chemical Test Guideline, ed. Chemicals Inspection Association (Kagakuhin Kensa Kyokai), published by Daiichi Hoki Shuppan K. K., on Oct. 1, 1981. The test for biodegradability was conducted by immersing specimens into an aqueous solution comprising an inorganic cultures solution and activated .slug to evaluate a decomposition rate, shown in terms of DOC (dissolved organic carbon). As a result, ferric complex salts (III) of EDTA exhibited little biodegradation, while ferric complex salts (III) of the exemplary compound (I-1) of the present invention exhibited 70% biodegradation. In this regard, the processing compositions of the present invention are preferred from the standpoint of environmental protection.

EXAMPLE 6

A Sample 601 was prepared in the same manner as Sample 101 of Example 1 in JP-A-4-34548. The Sample 601, thus prepared, was wedgewise exposed, and then processed in an automatic developing machine (suspending type) with the processing solutions and processing steps as follows.

The automatic processing was carried out continuously until the accumulated replenishment rate of the developer reached three times the tank capacity.

The processing steps are as follows.

| Step | Time (min.) | Temperature (°C.) | Running Solution (l) | Replenisher (ml/m$^2$) |
|---|---|---|---|---|
| 1st Development | 6 | 38 | 12 | 500 |
| 1st Rinse | 2 | 38 | 4 | 7500 |
| Reversal | 2 | 38 | 4 | 1100 |
| Color Development | 6 | 38 | 12 | 2200 |
| Pre-Bleach | 2 | 38 | 4 | 1100 |
| Bleach | 4 | 38 | 8 | 220 |
| Fixing | 4 | 38 | 8 | 1100 |
| 2nd Rinse | 4 | 38 | 8 | 7500 |
| Final Rinse | 1 | 25 | 2 | 1100 |

The composition of each of the processing solutions are as follows.

| | Running Solution (g) | Replenisher (g) |
|---|---|---|
| 1st Development solution | | |
| Pentasodium nitrilo-N,N,N-trimethylene sulfonate | 3.0 | 3.0 |
| Pentasodium diethylenetriamine pentaacetate | 3.0 | 3.0 |
| Sodium sulfite | 35 | 35 |
| Potassium hydroquinone-monosulfonate | 27 | 33 |
| Potassium carbonate | 15 | 20 |
| Sodium bicarbonate | 12 | 15 |
| 1-Phenyl-4-methyl-4-hydroxymethyl-3-pyrazolidone | 1.7 | 2.2 |
| Potassium bromide | 5.5 | — |
| Potassium thiocyanate | 1.2 | 1.4 |
| Potassium iodide | 15 (mg) | — |
| Diethylene glycol | 13 | 17 |
| Water to make | 1.0 (l) | 1.0 (l) |
| pH (adjusted with sulfuric acid or potassium hydroxide) | 9.6 | 9.6 |
| Reversal solution Common to both running solution and replenisher | | |
| Pentasodium nitrilo-N,N,N-trimethylene sulfonate | | 3.0 g |
| Stannous chloride.2$H_2O$ | | 1.0 |
| p-Aminophenol | | 0.1 |
| Sodium hydroxide | | 8 |
| Glacial acetic acid | | 15 (ml) |
| Water to make | | 1.0 (l) |
| pH (adjusted with acetic acid or sodium hydroxide) | | 6.0 |
| Color Development solution | | |
| Tetrasodium nitrilo-N,N,N-trimethylene sulfonate | 2.0 | 2.0 |
| Sodium sulfite | 7.0 | 7.0 |
| Sodium phosphate.12$H_2O$ | 36 | 36 |
| Potassium bromide | 1.0 | — |
| Potassium iodide | 90 (mg) | — |
| Sodium hydroxide | 3.0 | 3.0 |
| Citrazinic acid | 1.5 | 1.5 |
| N-Ethyl-N-(β-methanesulfonamidoethyl)-3-methyl-4-aminoaniline.3/2sulfuric acid.1$H_2O$ | 11 | 11 |
| 3,6-Dithiaoctane-1,8-diol | 1.0 | 1.0 |
| Water to make | 1.0 (l) | 1.0 (l) |
| pH (adjusted with sulfuric acid or potassium hydroxide) | | |
| Pre-bleaching solution | | |
| Disodium ethylenediamine- | 8.0 | 8.0 |

-continued

| | Running Solution (g) | Replenisher (g) |
|---|---|---|
| tetraacetate dihydrate | | |
| Sodium sulfite | 6.0 | 8.0 |
| 1-Thioglycerol | 0.4 | 0.4 |
| Formaldehyde sodium bisulfite additive | 30 | 35 |
| Water to make | 1.0 (l) | 1.0 (l) |
| pH (adjusted with acetic acid or sodium hydroxide) | 6.30 | 6.10 |
| Bleaching solution | | |
| Compound shown in Table 6 | 0.003 (mol) | 0.006 (mol) |
| Ferric (III) complex shown in Table 6 | 0.3 (mol) | 0.6 (mol) |
| Potassium bromide | 100 g | 200 g |
| Ammonium nitrate | 10 g | 20 g |
| Water to make | 1.0 (l) | 1.0 (l) |
| pH (Adjusted with nitric acid or sodium hydroxide) | 5.70 | 5.50 |
| Fixing solution Common to both running solution and replenisher | | |
| Ammonium thiosulfate | | 80 g |
| Sodium sulfide | | 5.0 |
| Sodium bisulfate | | 5.0 |
| Water to make | | 1.0 (l) |
| pH (adjusted with acetic acid or aqueous ammonia solution) | | 6.60 |
| Stabilizing solution | | |
| 1,2-Benzoisothiazolin-3-on | 0.02 | 0.03 |
| Polyoxyethylene-p-mono-nonylphenylether | 0.3 | 0.3 |
| Polymaleic acid (average M.W. 2,000) | 0.1 | 0.15 |
| Water to make | 1.0 (l) | 1.0 (l) |
| pH | 7.0 | 7.0 |

Sample 601 was uniformly exposed to light of 50 CMS and processed with the used processing solutions (i.e., when the developer replenishment amount reached three times the tank capacity). The residual silver amount of each of the samples after processing was determined by X-ray fluorescence. Results are shown in Table 6.

Separately, the magenta color developed density of 0.16 was determined and the results are shown relative to the magenta density tank as zero using ethylenediaminetetraacetic acid (EDTA).

TABLE 6

| Compound used | Amount of residual Ag | Magenta color developing density | |
|---|---|---|---|
| EDTA | 2.1 μg/cm$^2$ | 0 | Comparative |
| 1,3-PDTA | 0.2 | +0.08 | Comparative |
| I-1 | 0.2 | 0 | Invention |
| I-2 | 0.2 | −0.01 | Invention |
| I-3 | 0.2 | 0 | Invention |
| I-12 | 0.2 | 0 | Invention |

As shown in Table 6, the processing compositions of the present invention provided excellent bleaching properties, while effectively suppressing bleach fog.

EXAMPLE 7

Sample 701 was prepared in the same manner as described in Example 1 of JP-A-5-2241, except that the magenta coupler 2 was replaced by a compound of formula:

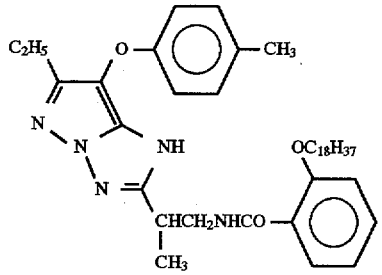

Sample 701, thus prepared, was imagewise exposed and processed with the steps shown below until the color developer was replenished by an amount of three times the tank capacity.

| Steps | Time (sec.) | Temperature (°C.) | Running Solution (l) | Replenisher (ml/m$^2$) |
|---|---|---|---|---|
| Black-and-white Development | 75 | 38 | 8 | 110 |
| 1st Rinse (1) | 45 | 33 | 5 | — |
| 1st Rinse (2) | 45 | 33 | 5 | 5,000 |
| Reversal Exposure (100 lux) | 15 | — | — | — |
| Color Development | 135 | 38 | 15 | 330 |
| 2nd Rinse | 45 | 33 | 5 | 1,000 |
| Blix (1) | 45 | 38 | 5 | — |
| Blix (2) | 45 | 38 | 5 | 220 |
| 3rd Rinse (1) | 45 | 33 | 5 | — |
| 3rd Rinse (2) | 45 | 33 | 5 | — |
| 3rd Rinse (3) | 45 | 75 | 5 | 5,000 |

In the 1st and 3rd rinse steps above, the was solution flows counter-currently. That is, the solution was charged in the 1st rinse step (2), and the overflow therefrom was introduced into the 3rd rinse step (t).

The photographic processing was carried out by varying the composition of each processing bath as set forth below under the conditions stated in Table 7.

| | Running Solution (g) | Replenisher (g) |
|---|---|---|
| Black-and-white developing solution | | |
| Pentasodium nitrilo-N,N,N',N'-trimethylenephosphonate | 1.0 | 1.0 |
| Pentasodium diethylenetri-aminetetraacetate | 3.0 | 3.0 |
| Potassium sulfite | 30.0 | 33.0 |
| Potassium thiocyanate | 1.2 | 1.2 |
| Potassium carbonate | 35.0 | 35.0 |
| Potassium hydroquinone monosulfate | 25.0 | 28.0 |
| 1-Phenyl-4-hydroxymethyl-4-methyl-3-pyrazolidone | — | 2.0 |
| Potassium bromide | 4.5 | — |
| Potassium iodide | 8.0 (mg) | — |
| Water to make | 1.0 (l) | 1.0 (l) |
| pH (adjusted with hydro-chloric acid or potassium hydroxide) | 9.60 | 9.70 |
| Color development solution | | |
| Benzyl alcohol | 15.0 (ml) | 18.0 (ml) |
| Diethylene glycol | 12.0 (ml) | 14.0 (ml) |
| 3,6-Dithia-1,8-octanediol | 0.2 | 0.25 |
| Pentasodium nitrilo-N,N,N-trimethylene phosphate | 1.0 | 1.0 |

-continued

| | Running Solution (g) | Replenisher (g) |
|---|---|---|
| Pentasodium diethylene triamine tetraacetate | 4.0 | 4.0 |
| Sodium sulfite | 2.0 | 2.5 |
| Hydroxylamine sulfate | 3.0 | 3.6 |
| N-Ethyl-N-(β-methanesulfonamidoethyl)-3-methyl-aminoaniline sulfate | 5.0 | 8.0 |
| Potassium carbonate | 20.0 | 23.0 |
| Optical brightening agent (diaminostylbene type) | 1.0 | 1.2 |
| Potassium bromide | 0.5 | — |
| Potassium iodide | 1.0 (mg) | — |
| Water to make | 1.0 (l) | 1.0 (l) |
| pH (adjusted with hydrochloric acid or potassium hydroxide) | 10.15 | 10.40 |
| Bleach-fixing solution Common to both running solution and replenisher | | |
| Ferric (III) complex salt of the compound indicated in Table 7 | | 200 mM |
| Compound indicated in Table 7 | | 10 Mm |
| Sodium sulfite | | 15.0 g |
| Ammonium thiosulfate (700 g/l) | | 130 ml |
| 2-Mercapto-1,3,4-triazole | | 0.5 g |
| Water to make | | 1.0 (l) |
| pH (adjusted with acetic acid or aqueous ammonia) | | 6.5 |

Once the developer replenisher amount reached three times the tank capacity, Sample 701 was wedgewise exposed to light of 100 CMS and processed as described above.

The residual silver amount in a minimum density portion of the processed sample was determined by X-ray fluorescence.

In a separate experiment, the processed samples were stored under conditions of 70% RE at 80° C. for 4 weeks to evaluate the variation in yellow density (ΔD) in a minimum density portion with a Macbeth densitometer.

$$\Delta D = (\text{Density after 4 weeks storage}) - (\text{Density before storage})$$

The results are shown in Table 7.

TABLE 7

| Compound | Residual Ag Amount (μg/cm²) | ΔD |
|---|---|---|
| EDTA | 4.3 | 0.10 |
| DTPA* | 6.5 | 0.12 |
| I-1 | 1.2 | 0.05 |
| I-2 | 1.3 | 0.05 |
| I-11 | 1.5 | 0.06 |
| I-14 | 1.5 | 0.06 |

*DTPA: diethylenetriaminepentaacetic acid

As clearly seen in the results of Table 7, the processing compositions of the present invention provided excellent desilvering properties and color image preservation stability, even for the case of processing a color reversal photographic material which presents an excess load to the bleach-fixing step.

EXAMPLE 8

Sample 801 was prepared in the same manner as described in Example 1, except that a polyethylene naphthalate having a thickness of 100 μm was used as a support in place of the subbed triacetic acid cellulose film of Sample 101. Furthermore, a stripe magnetic recording layer as disclosed in Example 1 of JP-A-4-124628 was coated over the backside surface of the support.

Sample 801, thus prepared, was evaluated as described in Example 1. The effects of the present invention were confirmed by the results of the Sample 801.

Separately, Sample 302 was prepared in the same manner as described in Example 1, except that the support and backing layer of Sample I-3 in Example 1 of JP-A-4-62543 was used in place of the support of Sample 101 of Example 1. Furthermore, 15 mg/m² of $C_8F_{17}SO_2N(C_3H_7)CH_2COOK$ were coated thereon as the 16th protective layer.

Sample 302, thus prepared, was formed into the format of FIG. 5 of JP-A-4-62543, and evaluated as described in Example 1. The effects of the present invention were thereby confirmed.

Thus, the processing composition of the present invention provides excellent desilvering properties, photographic properties and image preservability after processing, and causes little environmental pollution.

While the invention has been described in detail and with reference to specific embodiments thereof, it will be apparent to one skilled in the art that various changes and modifications can be made therein without departing from the spirit and scope thereof.

What is claimed is:

1. A process for processing an imagewise exposed silver halide color photographic material comprising a support having thereon at least one light-sensitive silver halide emulsion layer, comprising the steps of developing in a color developing solution containing a color developing agent and processing in a processing solution having a bleaching capacity, said processing solution having a bleaching capacity containing a bleaching agent which is a ferric (III) complex salt of an optical isomer represented by formula (I):

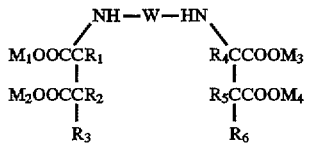

(I)

wherein $R_1$, $R_2$, $R_3$, $R_4$, $R_5$, and $R_6$ each represents a hydrogen atom, an aliphatic group, an aromatic group or a hydroxyl group; W represents a divalent linking group containing carbon atoms; and $M_1$, $M_2$, $M_3$ and $M_4$ each represents a hydrogen atom or a monovalent cation; wherein the chiral centers which have said S configurations are the carbon atoms to which the $R_1$ and $R_4$ groups are directly bonded.

2. The process of claim 1, wherein the aliphatic group represented by $R_1$, R2, $R_3$, $R_4$, $R_5$ and $R_6$ is a straight-chain, branched or cyclic alkyl group, alkenyl group or alkinyl group having from 1 to 10 carbon atoms, and the aromatic group represented by $R_1$, $R_2$, $R_3$, $R_4$, $R_s$ and $R_6$ is a monocyclic or bicyclic aryl group having from 6 to 10 carbon atoms.

3. The process of claim 1, wherein $R_1$, $R_2$, $R_3$, $R_4$, $R_5$ and $R_6$ each represents a hydrogen atom or a hydroxyl group.

4. The process of claim 1, wherein $R_1$, $R_2$, $R_3$, $R_4$, $R_5$ and $R_6$ each represents a hydrogen atom.

5. The process of claim 1, wherein the divalent linking group W is represented by:

$$-(W^1\text{-}D)_m-(W^2)_n-$$

wherein $W^1$ and $W^2$ which may be the same or different each represents a straight-chain or branched alkylene group, a cycloalkylene group, an arylene group, an aralkylene group or a carbonyl group; D represents —O—, —S—, —N($R_w$)— or a divalent nitrogen-containing heterocyclic group, where $R_w$ represents a hydrogen atom or an alkyl group or an aryl group, which alkyl group or aryl group may be substituted by —COOM$_a$, —PO$_3$M$_b$, M$_c$, —OH or —SO$_3$M$_d$, where M$_a$, M$_b$, M$_a$ and M$_d$ each represents a hydrogen atom or a monovalent cation; m represents 0 or an integer of 1 to 3; and n represents an integer of 1 to 3; and when m is 2 or 3, the plurality of ($W^1$-D) groups may be the same or different, and when n is 2 or 3, the plurality of $W^2$ groups may be the same or different.

6. The process of claim 1, wherein the divalent linking group W is represented by:

$$-(W^1\text{-}D)_m-(W^2)_n-$$

wherein $W^1$ and $W^2$, which may be the same or different, each represents a $C_{2-8}$ straight-chain or branched alkylene group, a $C_{5-10}$ cycloalkylene group, a $C_{6-10}$ arylene group, a $C_{7-10}$ aralkylene group or a carbonyl group; D represents —O—, —S—, —N($R_w$)— or a divalent nitrogen-containing heterocyclic group, where $R_w$ represents hydrogen atom or a $C_{1-8}$ alkyl group or a $C_{6-10}$ aryl group, which $C_{1-8}$ alkyl group or $C_{6-10}$ aryl group may be substituted by —COOM$_a$, —PO$_3$M$_b$, Me, —OH or —SO$_3$M$_d$, where M$_a$, M$_b$, M$_c$ and M$_d$ each represents a hydrogen atom or a monovalent cation; m represents 0 or an integer of 1 to 3; and n represents an integer of 1 to 3; and when m is 2 or 3, the plurality of ($W^1$-D) groups may be the same or different, and when n is 2 or 3, the plurality of $W^2$ groups may be the same or different.

7. The process of claim 5, wherein D represents —S—, —N($R_w$)— or a divalent nitrogen containing heterocyclic group, and m represents an integer of 1 to 3.

8. The process of claim 5, wherein $W^2$ represents a cycloalkylene group, an arylene group, an aralkylene group or a carbonyl group.

9. The process of claim 5, wherein m represents 0.

10. The process of claim 6, wherein $W^1$ and $W^2$ each represents a $C_{2-4}$ alkylene group.

11. The process of claim 1, wherein the concentration of the ferric (III) complex salt of the compound represented by formula (I) is in the range of from 0.02 to 0.50 mol/l. formula (I) is in the range of from 0.005 to 0.030 mol/l.

12. The process of claim 1, wherein the processing solution having a bleaching capacity further comprises an inorganic oxidizer selected from the group consisting of hydrogen peroxide, a persulfate and a bromate, and the concentration of the ferric (III) complex salt of the compound represented by formula (I) is in the range of from 0.005 to 0.030 mol/l.

13. The process of claim 1, wherein 50 mol % or more of ferric complex salts contained in the processing solution are ferric (III) complex salts of the compound represented by formula (I).

14. The process of claim 1, wherein the processing solution is a bleaching solution having a pH of from 3.0 to 7.0.

15. The process of claim 1, wherein the processing solution is a blix solution having a pH of from 3.0 to 8.0.

16. The process of claim 1, wherein the processing solution having a bleaching capacity further comprises an organic acid having a pKa value of 2.0 to 5.5 in an amount of 0.1 to 1.2 mol/l.

17. The process of claim 1 further comprising processing in a processing solution having fixing capacity, said processing solution having a fixing capacity contains a compound having a pKa of 6 to 9 as a buffer agent.

18. The process of claim 17, wherein the compound having a pKa of 6 to 9 is an imidazole.

19. The process of claim 18, wherein the compound having a DKa of 6 to 9 is imidazole or 2-methylimidazole.

20. A process as claimed in claim 5, wherein at least one of said straight-chain or branched alkylene groups represented by $W^1$ and $W^2$, at least one of said cycloalkylene groups represented by $W^1$ and $W^2$, at least one of said arylene groups represented by $W^1$ and $W^2$, and at least one of said aralkylene groups represented by $W^1$ and $W^2$, is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

21. A process as claimed in claim 6, wherein at least one of said $C_{2-8}$ straight-chain or branched alkylene groups represented by $W^1$ and $W^2$, at least one of said $C_{5-10}$ cycloalkylene groups represented by $W^1$ and $W^2$, at least one of said $C_{6-10}$ arylene groups represented by $W^1$ and $W^2$, and at least one of said $C_{7-10}$ aralkylene groups represented by $W^1$ and $W^2$, is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

22. A process as claimed in claim 10, wherein at least one of said $C_{2-4}$ alkylene groups represented by $W^1$ and $W^2$, is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

23. The process of claim 1, wherein the compound represented by formula (I) is synthesized from an amino acid in form.

24. A process for processing an imagewise exposed silver halide color photographic material as claimed in claim 1, wherein said aliphatic group represented by $R_1$, $R_2$, $R_3$, $R_4$, $R_5$, and $R_6$ is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, .alkoxycarbonyl, acyloxy, carbonamide, sulfonamide, nitro and hydroxamic acid.

25. A process for processing an imagewise exposed silver halide color photographic material as claimed in claim 1, wherein said aromatic group represented by $R_1$, $R_2$, $R_3$, $R_4$, $R_5$, and $R_6$ is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

26. The process of claim 1, wherein the compound represented by formula (I) is synthesized from an amino acid in L-form.

27. A processing composition for processing a silver halide photographic material, comprising an aqueous solution of a ferric (III) complex salt of an optical isomer represented by formula (I):

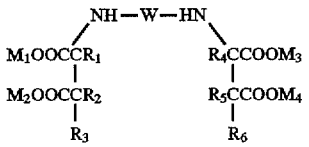

(I)

wherein $R_1$, $R_2$, $R_3$, $R_4$, $R_5$, and $R_6$ each represents a hydrogen atom, an aliphatic group, a an aromatic group or a hydroxyl group; $M_1$, $M_2$, $M_3$ and $M_4$ each represents a hydrogen atom or a monovalent cation; and W is a divalent linking group represented by:

$$-(W^1\text{-}D)_m-(W^2)_n-$$

wherein $W^1$ and $W^2$, which may be the same or different, each represents a propylene group, a $C_{5-10}$ cycloalkylene group, a $C_{6-10}$ arylene group, a $C_{7-10}$ aralkylene group, or a carbonyl group; D represents —O—, —S—, —N($R_w$)— or a divalent nitrogen-containing heterocyclic group, where $R_w$ represents a hydrogen atom or a $C_{1-8}$ alkyl group or a $C_{6-10}$ aryl group, which $C_{1-8}$ alkyl group or $C_{6-10}$ aryl group may be substituted by —$COOM_a$, —$PO_3M_b$, $M_c$, —OH or —$SO_3$ $M_d$, where $M_a$, $M_b$, $M_c$ and $M_d$ each represents a hydrogen atom or a monovalent cation; m represents 0 or an integer of 1 to 3; and n represents an integer of 1 to 3; and when m is 2 or 3, the plurality of (W=-D) groups may be the same or different, and when n is 2 or 3, the plurality of $W^2$ groups may be the same or different; wherein the chiral centers which have said S configurations are the carbon atoms to which the $R_1$ and $R_4$ groups are directly bonded.

28. The processing composition of claim 27, wherein D represents —S—, —N($R_w$)— or a divalent nitrogen containing heterocyclic group, and m represents an integer of 1 to 3.

29. The processing composition of claim 27, wherein $W^2$ represents a cycloalkylene group, an arylene group, an aralkylene group or a carbonyl group.

30. A processing composition for processing a silver halide photographic material as claimed in claim 27, wherein said aliphatic group represented by $R_1$, $R_2$, $R_3$, $R_4$, $R_5$, and $R_6$ is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

31. A processing composition for processing a silver halide group represented by $R_1$, $R_2$, $R_3$, $R_4$, $R_5$, and $R_6$ is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

32. A processing composition for processing a silver halide photographic material as claimed in claim 27, wherein at least one of said propylene groups represented by $W^1$ and $W^2$, at least one of said $C_{5-10}$ cycloalkylene groups represented by $W^1$ and $W^2$, at least one of said $C_{6-10}$ arylene groups represented by $W^1$ and $W^2$, and at least one of said $C_{7-10}$ aralkylene groups represented by $W^1$ and $W^2$, is substituted with at least one substituent selected from the group consisting of alkyl, aralkyl, alkenyl, alkinyl, alkoxy, aryl, amino, acylamino, sulfonylamino, ureido, urethane, alkoxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

33. A bleaching composition for processing a silver halide color photographic material, comprising an aqueous solution of a ferric (III) complex salt of an optical isomer represented by formula (I):

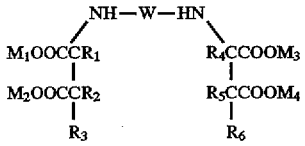

(I)

wherein $R_1$, $R_2$, $R_3$, $R_4$, $R_5$, and $R_6$ each represents a hydrogen atom, an aliphatic group, an aromatic group or a hydroxyl group; $M_1$, $M_2$, $M_3$ and $M_4$ each represents a hydrogen atom or a monovalent cation; and W is a divalent linking group represented by:

$$-(W^1\text{-}D)_m-(W^2)_n-$$

wherein $W^1$ and $W^2$, which may be the same or different, each represents a propylene group, a $C_{5-10}$ cycloalkylene group, a $C_{6-10}$ arylene group, a $C_{7-10}$ aralkylene group, or a carbonyl group; D represents —O—, —S—, —N($R_w$)— or a divalent nitrogen-containing heterocyclic group, where $R_w$ represents a hydrogen atom or a $C_{1-8}$ alkyl group or a $C_{6-10}$ aryl group, which $C_{1-8}$ alkyl group or $C_{6-10}$ aryl group may be substituted by —$COOM_a$, —$PO_3M_b$, $M_c$, —OH or —$SO_3M_d$, where $M_a$, $M_b$, $M_c$ and $M_d$ each represents a hydrogen atom or a monovalent cation; m represents 0 or an integer of 1 to 3 and n represents an integer of 1 to 3; and when m is 2 or 3, the plurality of ($W^1$-D) groups may be the same or different, and when n is 2 or 3, the plurality of $W^2$ groups may be the same or different; wherein the chiral centers which have said S configurations are the carbon atoms to which the $R_1$ and $R_4$ groups are directly bonded.

34. A bleaching composition for processing a silver halide color photographic material as claimed in claim 33, wherein at least one of said propylene groups represented by $W^1$ and $W^2$, at least one of said $C_{5-10}$ cycloalkylene groups represented by $W^1$ and $W^2$, at least one of said $C_{6-10}$ arylene groups represented by $W^m$ and $W^2$, and at least one of said $C_{7-10}$ aralkylene groups represented by $W^1$ and $W^2$, is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

35. A bleaching composition for processing a silver halide color photographic material as claimed in claim 33, wherein said aromatic group represented by $R_1$, $R_2$, $R_3$, $R_4$, $R_5$, and $R_6$ is substituted with at least one substituent selected from the group consisting of alkyl, aralkyl., alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

36. A bleaching composition for processing a silver halide color photographic material as claimed in claim 33, wherein said aliphatic group represented by $R_1$, $R_2$, $R_3$, $R_4$, $R_5$, and $R_6$ is substituted with at least one substituent selected from the group consisting of alkyl, aralkyl, alkenyl, alkinyl, alkoxy, aryl, amino, acylamino, sulfonylamino, ureido, urethane, aryloxy, sulfamoyl, carbamoyl, alkylthio, arylthio, sulfonyl, sulfinyl, hydroxyl, halogen, cyano, sulfo, carboxyl, phosphono, aryloxycarbonyl, acyl, alkoxycarbonyl, acyloxy, carbonamide, sulfonamide, nitro and hydroxamic acid.

* * * * *

UNITED STATES PATENT AND TRADEMARK OFFICE

CERTIFICATE OF CORRECTION

PATENT NO. : 5,679,501
DATED : October 21, 1997
INVENTOR(S) : Hiroyuki Seki, et. al.

It is certified that error appears in the above-identified patent and that said Letters Patent is hereby corrected as shown below:

Title page, item [54] and col. 1, should read --
"PROCESSING COMPOSITION HAVING A BLEACHING CAPACITY FOR A SILVER HALIDE PHOTOGRAPHIC MATERIAL CONTAINING A FERRIC (III) COMPLEX SALT OF A DIAMINE COMPOUND AS A BLEACHING AGENT AND A PROCESSING METHOD USING THE SAME"

In claim 1, line 9, between "optical" and "isomer" insert -- [S,S] --."

In claim 2, line 2, "R2" should read -- $R_2$ --; and
line 5, "$R_r$" should read -- $R_5$ --.

In claim 5, line 4, after "$W^2$" and after "different" insert a comma --,--; and
line 12, the second occurrence of "$M_a$" should read -- $M_c$ --.

In claim 6, line 12, "Me" should read -- $M_c$ --.

In claim 11, delete the fourth line in its entirety.

In claim 23, line 3, before "form" insert -- [S,S] --.

In claim 24, line 10, ".alkoxycarbonyl" should read -- alkoxycarbonyl --.

In claim 27, line 3, between "optical" and "isomer" insert -- [S,S] --; and
line 23, "(W=-D)" should read -- ($W^1$-D) --.

UNITED STATES PATENT AND TRADEMARK OFFICE

CERTIFICATE OF CORRECTION

PATENT NO. : 5,679,501
DATED : October 21, 1997
INVENTOR(S) : Hiroyuki Seki, et. al.

It is certified that error appears in the above-identified patent and that said Letters Patent is hereby corrected as shown below:

In claim 28, lines 2 and 3, "nitrogen containing" should read -- nitrogen-containing --.

In claim 32, line 11, "alkoxy" should read -- aryloxy --.

In claim 33, line 3, between "optical" and "isomer" insert -- [S,S] --.

In claim 35, line 5, "aralkyl." should read -- aralkyl --.

In claim 36, line 3, "$R_s$" should read -- $R_5$ --.

Signed and Sealed this

Thirtieth Day of June, 1998

*Attest:*

*Attesting Officer*

Bruce Lehman

BRUCE LEHMAN

*Commissioner of Patents and Trademarks*